US010838313B2

(12) United States Patent
Araki et al.

(10) Patent No.: US 10,838,313 B2
(45) Date of Patent: Nov. 17, 2020

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Kazuko Araki, Tokyo (JP); Kaname Watariguchi, Yokohama (JP); Masataka Kawahara, Mishima (JP); Jumpei Kuno, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/960,117

(22) Filed: Apr. 23, 2018

(65) Prior Publication Data

US 2018/0314170 A1 Nov. 1, 2018

(30) Foreign Application Priority Data

Apr. 28, 2017 (JP) ..... 2017-089520

(51) Int. Cl.
*G03G 5/06* (2006.01)
*G03G 5/05* (2006.01)

(52) U.S. Cl.
CPC ..... *G03G 5/0696* (2013.01); *G03G 5/0542* (2013.01); *G03G 2215/00957* (2013.01)

(58) Field of Classification Search
CPC ..... G03G 5/0696
See application file for complete search history.

(56) References Cited

U.S. PATENT DOCUMENTS 5,482,811 A * 1/1996 Keoshkerian ..... G03G 5/0696 430/133
5,663,327 A * 9/1997 Tambo ..... C09B 67/0016 540/139
5,885,737 A * 3/1999 Tanaka ..... C07F 5/003 399/111
5,932,722 A * 8/1999 Hirai ..... G03G 5/0696 430/78

(Continued)

FOREIGN PATENT DOCUMENTS

JP H07319188 A 12/1995
JP 2001265032 A 9/2001

(Continued)

OTHER PUBLICATIONS

Girgsdies, F. "Peak Profile Analysis in X-ray Powder Diffraction" Electron Microscopy Group, Department of Inorganic Chemistry, Fritz-Haber-Institut der MPG, Berlin, Germany. (no date) 53 pages.*

(Continued)

*Primary Examiner* — Christopher D Rodee
(74) *Attorney, Agent, or Firm* — Canon U.S.A., Inc. IP Division

(57) ABSTRACT

An electrophotographic photosensitive member includes, in this order, a support, a charge generating layer having a thickness of more than 200 nm and containing a hydroxygallium phthalocyanine pigment or a chlorogallium phthalocyanine pigment as a charge generating material, and a charge transport layer containing a charge transporting material. The charge generating material satisfies a requirement for a specific parameter.

4 Claims, 4 Drawing Sheets

(56) References Cited

U.S. PATENT DOCUMENTS

| | | | | |
|---|---|---|---|---|
| 2002/0001765 | A1* | 1/2002 | Tanaka | C09B 67/0019 430/59.4 |
| 2006/0286469 | A1* | 12/2006 | Wu | G03G 5/0614 430/58.8 |
| 2015/0362850 | A1* | 12/2015 | Tanaka | C09B 67/0026 430/56 |
| 2016/0216620 | A1* | 7/2016 | Nishida | G03G 5/0696 |
| 2017/0123330 | A1* | 5/2017 | Watariguchi | C09B 67/0026 |

FOREIGN PATENT DOCUMENTS

| | | | |
|---|---|---|---|
| JP | 2003280232 | A | 10/2003 |
| JP | 2012128061 | A | 7/2012 |

OTHER PUBLICATIONS

Kazuki Inami, The Crystal Structure of Hydroxygalliumphthalocyanine Type V, 1994, pp. 221-224 (issued Jun. 1994).

I. Nakai, et al., Funmatsu X-sen kaiseki no jissai (The Practice of Powder X-ray Analysis, in Japanese), pp. 63, 120-123, 135-136 (line 28 to p. 136, left section, line 4), 119, and 140-142, Asakura Publishing Co., Ltd.

Application Analysis User Manual of the Integrated Powder X-ray Analysis Software Program PDXL 2. 2, p. 53.

* cited by examiner

ELECTROPHOTOGRAPHIC PHOTOSENSITIVE MEMBER, PROCESS CARTRIDGE, AND ELECTROPHOTOGRAPHIC APPARATUS

BACKGROUND

Field of the Disclosure

The present disclosure relates to an electrophotographic photosensitive member, and a process cartridge and an electrophotographic apparatus each including the electrophotographic photosensitive member.

Description of the Related Art

Multilayer photosensitive layers including a charge generating layer containing a charge generating material and a charge transport layer containing a charge transporting material are the mainstream of the photosensitive layer of electrophotographic photosensitive members. Multilayer photosensitive layers have advantages of, for example, being highly sensitive and allowing a variety of material design.

Phthalocyanine pigments, which are superior as photoconductors and are highly sensitive to light in a wide range of wavelengths, are used as a charge generating material of the electrophotographic photosensitive member of electrophotographic apparatuses using a semiconductor laser capable of oscillation in a wide range of wavelengths as an image exposure device. It has been known that phthalocyanine pigments exhibit various electrical properties, depending on the crystal form thereof and also on the manufacturing process (which varies in treating method performed by, for example, UV irradiation, pulverization, or using solvent, or in synthesizing method) even if the crystal form is the same.

The charge generating layer of an electrophotographic photosensitive member used in an image quality-oriented printer may have a large thickness. A thick charge generating layer reduces the amount of light that can reach the layer(s) and support under the charge generating layer, thus suppressing multiple light scattering in the photosensitive member and accordingly reducing interference fringes.

The thick charge generating layer, however, increases dark decay. A large dark decay can be one of the causes of fogging over the non-image area (phenomenon in which toner is developed in an area where charged potential is reduced) and may affect the resulting image. A measure against the increase in dark decay is desired. As one of the measures to suppress the increase in dark decay, the electrical properties of the phthalocyanine pigment used as the charge generating material may be improved. More specifically, as disclosed in Japanese Patent Laid-Open Nos. 7-319188, 2012-128061, 2001-265032, and 2003-280232, the phthalocyanine pigment may be improved in peak intensity, or a plurality of phthalocyanine pigments may be mixed.

Japanese Patent Laid-Open No. 7-319188 discloses an electrophotographic photosensitive member including a photosensitive layer containing a binder resin and a titanyl phthalocyanine pigment dispersed in the binder resin. The titanyl phthalocyanine pigment exhibits a CuKα X-ray diffraction spectrum having the strongest peak at a Bragg angle 2θ±0.2° of 26.3° with a half width (full width at half maximum) of 0.4° or less. The charged potential of this electrophotographic photosensitive member is not much reduced even by repeated use, and thus the electrophotographic photosensitive member exhibits improved electrical properties. The half width depends on the manufacturing conditions, such as the time for pulverization or dispersion, the size and specific gravity of the pulverization or dispersion media such as beads or balls, and the rotational speed of the pulverization or dispersion mill such as a ball mill. This document explains that this is because the crystal lattice of the titanyl phthalocyanine can be irregularly distorted by the stress placed thereon by pulverization or dispersion.

Japanese Patent Laid-Open No. 2002-40692 discloses a hydroxyphthalocyanine pigment that exhibits a CuKα X-ray diffraction spectrum having peaks at Bragg angles 2θ±0.2° of 7.5°, 9.9°, 12.5°, 16.3°, 18.6°, 25.1°, and 28.3°, wherein the half width of the diffraction peak at 7.5° is 0.35° to 1.2°. This document describes that such a hydroxyphthalocyanine pigment is dispersible in binder resin and that the use thereof enables the sensitivity of the electrophotographic photosensitive member to be controlled in a sufficiently wide range. According to this document, the half width depends on the pulverization force and time that are varied by the pulverization process, a dry process or a wet process, or on the manufacturing conditions. Also, this document describes that a pigment particle size of 0.3 μm or less is an index of whether or not the pigment reaches a desired half width through the pulverization and the like. It is thus known how to associate a half width of the X-ray diffraction spectrum with the particle size effective in dispersing the pigment.

Japanese Patent Laid-Open No. 2001-265032 discloses an electrophotographic photosensitive member including a photosensitive layer containing a titanyl phthalocyanine pigment exhibiting an X-ray diffraction spectrum in which the main peak at a Bragg angle 2θ±0.2° of 10° or less has a specific half width. The half width (Δ2θ) specified in this document is considered to be a value corresponding to the size of the titanyl phthalocyanine crystals and is used as an evaluation index for controlling the state of the crystals. This document describes that when the half width is within a specific range, that is, when the size of the crystals is within a specific range, the retention of charged potential in repeated use can be improved.

Japanese Patent Laid-Open No. 2003-280232 discloses an electrophotographic photosensitive member including a photosensitive layer containing a pigment produced by amorphizing a titanyloxy phthalocyanine exhibiting the largest peak at a Bragg angle 2θ±0.2° of 7.6° that is at least five times as high as the peak at 28.7°. According to this disclosure, the use of such a titanyl phthalocyanine pigment as the starting material provides a highly sensitive pigment that can stabilize charged potential. It is described in this disclosure that the height ratio of the peaks varies, due to unknown causes, even among the pigments purified by the same method.

Japanese Patent Laid-Open No. 2012-128061 discloses an electrophotographic photosensitive member including a photosensitive layer containing a plurality of pigments including titanyl phthalocyanine and a diol adduct thereof that exhibit peaks at Bragg angles of 8.3° and 7.5° with a specific peak intensity ratio. In this document, the proportion of the two crystalline materials is determined by specifying the intensity ratio between the peak at 7.5° derived from the titanyl phthalocyanine and the peak at 8.3° derived from the diol adduct. According to this document, when the peak intensity ratio is within the specific range, the pigments are effective in improving potential stability in repeated use.

As described in the above-cited documents, X-ray diffractometry is often used for associating the electrical properties of phthalocyanine pigment with the crystal form or the size of crystals of the phthalocyanine pigment. Also, it is being attempted to numerically associate the half width of a diffraction peak at a specific Bragg angle with distortion or nonuniformity of crystal lattice, or the size of crystals.

SUMMARY

Accordingly, an aspect of the present disclosure is directed to an electrophotographic photosensitive member including, in this order, a support, a charge generating layer having a thickness of more than 200 nm and containing a hydroxygallium phthalocyanine pigment as a charge generating material, and a charge transport layer containing a charge transporting material. The hydroxygallium phthalocyanine pigment exhibits a CuKα X-ray diffraction spectrum having peaks at Bragg angles 2θ of 7.4°±0.3° and 28.2°±0.3° and satisfies a requirement that A represented by the following equation (1) is 0.80 or less, wherein in the equation (1), $\theta_1$ and $\beta_1$ respectively represent the angle and the integral width of the peak at the Bragg angle 2θ of 7.4°±0.3°, and $\theta_2$ and $\beta_2$ respectively represent the angle and the integral width of the peak at the Bragg angle 2θ of 28.2°±0.3°.

Another aspect of the present disclosure is directed to an electrophotographic photosensitive member including a support, a charge generating layer having a thickness of more than 200 nm and containing a chlorogallium phthalocyanine pigment as a charge generating material, and a charge transport layer containing a charge transporting material in this order. The chlorogallium phthalocyanine pigment exhibits a CuKα X-ray diffraction spectrum having peaks at Bragg angles 2θ±0.2° of 7.4°, 16.6°, 25.5°, and 28.4° and satisfies a requirement that A represented by equation (1) is 1.10 or less, wherein in the equation (1), $\theta_1$ and $\beta_1$ respectively represent the angle and the integral width of the peak at the Bragg angle 2θ±0.2° of 7.4°, and $\theta_2$ and $\beta_2$ respectively represent the angle and the integral width of the peak at the Bragg angle 2θ±0.2° of 28.4°.

$$A = \frac{\beta_1 \cos\theta_1}{\beta_2 \cos\theta_2} \tag{1}$$

The present disclosure is also directed to a process cartridge capable of being removably attached to an electrophotographic apparatus. The process cartridge includes the electrophotographic photosensitive member and at least one device selected from the group consisting of a charging device, a developing device, and a cleaning device. The electrophotographic photosensitive member and the at least one device are held in one body.

Also, an electrophotographic apparatus is provided. The electrophotographic apparatus includes the above-described electrophotographic photosensitive member, a charging device, an exposure device, a developing device, and a transfer device.

The electrophotographic photosensitive member according to the present disclosure and the process cartridge and the electrophotographic apparatus that include the electrophotographic photosensitive member can reduce dark decay and produce such high-quality images as have recently been demanded.

Further features of the present disclosure will become apparent from the following description of exemplary embodiments with reference to the attached drawings.

DESCRIPTION OF THE EMBODIMENTS

Phthalocyanine pigments have been improved in a variety of ways for use as a charge generating material in electrophotographic photosensitive members.

According to researches by the present inventors, however, the above-cited known photosensitive members have not fully brought out the advantageous electrophotographic properties of the phthalocyanine pigment itself, and further improvement in reducing dark decay is desired.

Accordingly, the present disclosure provides an electrophotographic photosensitive member that can reduce dark decay and produce such high-quality images as have recently been demanded even when it includes a multilayer photosensitive layer having a thick charge generating layer, and a process cartridge and an electrophotographic apparatus each including the electrophotographic photosensitive member.

The subject matter of the present disclosure will be described in detail in the following exemplary embodiments.

The definition of parameter A used herein will now be described. First, value r is calculated from the CuKα X-ray diffraction spectrum by using the Scherrer equation.

The Scherrer equation is represented as below:

$$r = \frac{K\lambda}{\beta \cos\theta} \tag{2}$$

wherein K represents Scherrer constant (shape factor); λ represents the X-ray wavelength (nm) (in the case of a CuKα X-ray diffraction spectrum, λ=0.154 nm); β represents the integral width (rad); and θ represents the Bragg angle.

Two angles $\theta_1$(°) and $\theta_2$(°) of the angles at which peaks appear are selected from the CuKα X-ray diffraction spectrum of the phthalocyanine pigment, and the respective integral widths of the diffraction peaks at the angles $\theta_1$ and $\theta_2$ are defined as $\beta_1$(°) and $\beta_2$(°), respectively. Parameter A is defined by the following equation with r values $r_1$ (nm) and $r_2$ (nm):

$$A = \frac{r_2}{r_1} \tag{3}$$

In the case of a hydroxygallium phthalocyanine pigment, 7.4°±0.3° which is one of the Bragg angles 2θ is defined as $2\theta_1$, and 28.2°±0.3° which is another Bragg angle 2θ is defined as $2\theta_2$. In the case of a chlorogallium phthalocyanine pigment, 7.4° which is one of the Bragg angles 2θ±0.2°: 7.4°, 16.6°, 25.5°, and 28.4° is defined as $2\theta_1$, and 28.4° which is another of the Bragg angles is defined as $2\theta_2$.

Figure 2:
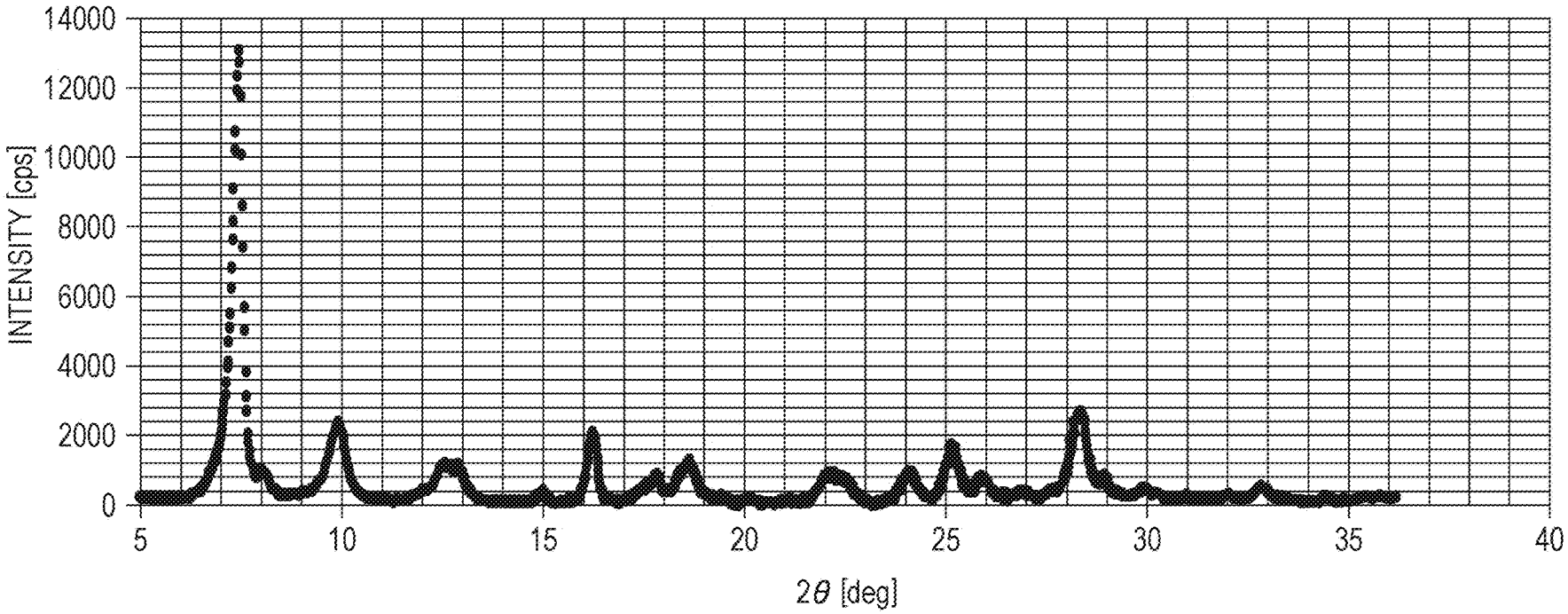
FIG. 2 is a CuKα X-ray diffraction spectrum of the hydroxygallium phthalocyanine pigment produced in Example 16, according to one more aspect of the subject disclosure.

It is known that the phthalocyanine molecule has a plate-like form in which the π orbitals extend in a direction perpendicular to the plane of the molecule (molecular axis direction). Thus, the phthalocyanine pigment has a columnar structure in which phthalocyanine molecules are stacked in such a manner that the planes of the molecules oppose each other by the intermolecular interaction thereof. Therefore, many of the phthalocyanine pigments, particularly V-type hydroxygallium phthalocyanine pigments, exhibit characteristic X-ray diffraction spectra. For example, as shown in FIG. 2, the strongest peak appears at a Bragg reflection angle $2\theta_1$ around 7.4°, and the second strongest peak appears at $2\theta_2$ around 28.20. Rietveld's crystal structure analysis results have revealed that these two Bragg reflections result from the diffraction at the (0 1 0) plane and the (2 −1 −2) plane, the former being the diffraction plane parallel to the molecular axis direction, the latter being the diffraction plane parallel to the π stacking direction (reference: Japan Hardcopy '94, pp. 221-224 (issued June 1994). It is assumed that the X-ray diffraction spectrum of a phthalocyanine pigment in such a stacked structure by an intermolecular interaction has strong reflection peaks resulting from a diffraction in the molecular axis direction perpendicular to the direction in which the molecules are stacked and a diffraction in the a stacking direction.

Figure 1:
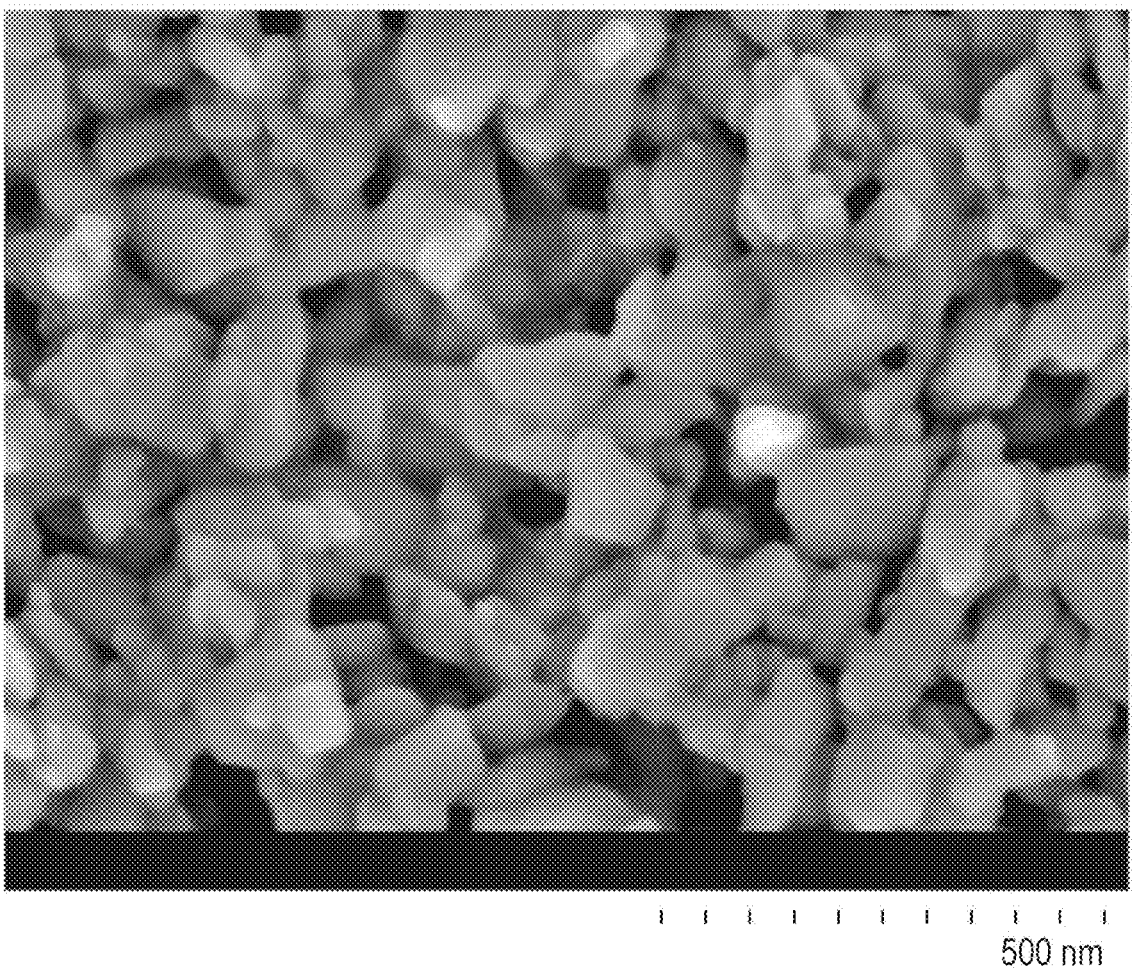
FIG. 1 is an SEM micrograph of the hydroxygallium phthalocyanine pigment produced in Example 16, according to one more aspect of the subject disclosure.

The terms "crystalline particle", "crystallite correlation length" and the r value mentioned herein will now be described. The "crystalline particle" of a phthalocyanine pigment mentioned herein refers to the primary particle defined by an aggregate of phthalocyanine molecules. FIG. 1 shows a scanning electron microscope (SEM) image of a phthalocyanine pigment. Each of the lumps shown in FIG. 1 is a crystalline particle. The term "crystallite correlation length" of a phthalocyanine pigment mentioned herein refers to the size of a region that can be considered to be a phthalocyanine single crystal in the crystalline particle. The crystallite correlation length depends on the crystal distortion defined as local irregularity in distance between crystal planes or in orientation of crystal planes, and depends on the size of the crystallite defined as a region that locally has a crystal distortion but, from a view of a wide region, does not vary in distance between crystal planes or in orientation of crystal planes (reference: Nakai, I. & Izumi, F., "Funmatsu X-sen kaiseki no jissai" (The Practice of Powder X-ray Analysis, in Japanese), p. 63, Asakura Publishing Co., Ltd.) Crystal distortion and crystallites cannot be recognized in the SEM micrograph shown in FIG. 1. In the present disclosure, the value "r" calculated from the CuKα X-ray diffraction spectrum of a phthalocyanine pigment by using the Scherrer equation is considered to be the "crystallite correlation length" of the phthalocyanine pigment.

A broadening of diffraction line width in powder X-ray diffraction results from two reasons: the apparatus; and the sample. The broadening resulting from the sample is that resulting from the crystal distortion and the size of crystallites viewed from a wide region. The diffraction line width used herein is the diffraction line width obtained by subtracting the line width broadening resulting from the apparatus, as described herein later. In the electrophotographic photosensitive member industry, the size of phthalocyanine pigment is often estimated from the half width of an independent peak (particularly on the low angle side), as disclosed in the above-cited documents. Indeed, the crystallite correlation length of molecular crystals such as phthalocyanine pigment varies among Bragg angles each representing a diffraction plane. The intermolecular force in each plane direction of molecular crystals is anisotropic depending on the shape of the molecule and the orientation. Accordingly, the molecule of solvent enters the lattice through different positions during crystal transformation and, thus, the ease of crystal growth varies. It is therefore assumed that the crystallite correlation length in the molecular axis direction is different from the crystallite correlation length in the π stacking direction.

The present inventors have found, through their studies, that the dark decay of an electrophotographic photosensitive member has a correlation with the following parameter A representing the ratio of "crystallite correlation lengths r" corresponding to two Bragg angles. Parameter A is represented by the ratio of the crystallite correlation length $r_2$ in the it stacking direction ($\theta_2$) to the crystallite correlation length $r_1$ in the molecular axis direction ($\theta_1$) as below:

$$A = \frac{r_2}{r_1} = \frac{\beta_1 \cos\theta_1}{\beta_2 \cos\theta_2} \tag{4}$$

From this equation, in the present disclosure, parameter A is defined as a value calculated by equation (1):

$$A = \frac{\beta_1 \cos\theta_1}{\beta_2 \cos\theta_2} \tag{1}$$

A smaller crystallite correlation length r suggests that phthalocyanine molecules are in a larger misalignment at the corresponding diffraction plane, and that the length of a continuous region that can be considered to be a crystal is smaller. In other words, as parameter A decreases, the molecular alignment in the π stacking direction ($\theta_2$) becomes worse compared with the alignment in the molecular axis direction ($\theta_1$). Since charge carriers in a molecular solid migrate between the adjacent orbitals, the present inventors assume that there is some correlation between parameter A representing the ratio of the degree of alignment in the π stacking direction to the degree of alignment in the molecular axis direction and the dark decay resulting from charge generation in the charge generating layer and migration and retention of the charge carriers when the photosensitive member is charged.

Japanese Patent Laid-Open No. 2003-280232 discloses an example in which the correlation between an electrophotographic property and a pigment produced by amorphizing a titanyl phthalocyanine having a specific intensity (peak height) ratio between the peaks on the lower angle side and the higher angle side is numerically specified. If a sample has a crystal distortion or variation in crystallite size, the peaks of the diffraction line shift slightly. Accordingly, the relationship between the peak intensities of the diffraction line may vary, and the range of the variation is probably not affected to such an extent as the variation resulting from the ratio between the crystallite correlation lengths, to which the present disclosure pay attention, becomes negligible. In some examinations by the present inventors, the ratio between the intensity of the strongest peak (in the present disclosure, at $2\theta_1$=7.4° for both the hydroxygallium phthalocyanine pigment and the chlorogallium phthalocyanine pigment) of the peaks appearing on the lower angle side and the intensity of the strongest peak (in the present embodiment, at $2\theta_2$=28.2° for the hydroxygallium phthalocyanine pigment, and at $2\theta_2$=28.4° for the chlorogallium phthalocyanine pigment) of the peaks appearing on the higher angle side hardly varied, and, thus, the peak intensity ratio did not have a correlation with dark decay characteristics varied depending on the production process. Organic molecular crystals such as phthalocyanine pigment often exhibit a habit of needle or plate crystals, and the "preferred orientation" influences the peak intensities. In the present disclosure, the effect of preferred orientation is eliminated by the method described later to obtain accurate diffraction spectra with good repeatability.

As the molecular alignment in the t stacking direction is better (or as the length of the continuity is lager), the region where π electrons overlap become larger. It is therefore assumed that the highest occupied molecule orbital (HOMO) spreads more widely and, accordingly, functions to help electrons to migrate in the crystalline particles. In practice, however, as parameter A decreases, that is, as the alignment in the π stacking direction becomes disordered compared with the state of the alignment in the molecular axis direction, dark decay decreases. Although this fact seems to be disadvantageous for migration of charges, the present inventors believe that the presence of relative distortion between diffraction planes that can be considered to be closely correlative to charge generation, migration and retention leads to reduced dark decay. The reason will be explained below.

Pigments satisfying A≤0.8 exhibit significantly reduced dark decay particularly when the thickness of the charge generating layer is small. One of the causes of dark decay is injection of heat carriers generated from the charge generating material. As the charge generating layer has a larger thickness, the absolute amount of charge generating material increases. Thus, the thickness of the charge generating layer dominates the magnitude of dark decay. While the relationship between the heat carriers and the crystal structure has not been clear, the present inventors assume that as relative distortion between diffraction planes is larger, the formation of conductive paths of the heat carriers is appropriately hindered, suppressing the generation or the migration of heat carriers.

As described above, parameter A represents the ratio between the diffraction plane parallel to the π stacking direction and the distortion plane parallel to the molecular axis direction (ratio between crystallite sizes). According to the examination results by the present inventors, when the parameter A of hydroxygallium phthalocyanine pigment is 0.80 or less, or when the parameter A of chlorogallium phthalocyanine pigment is 1.10 or less, there is a high correlation between parameter A and dark decay. On the other hand, when the parameter A of hydroxygallium phthalocyanine pigment was larger than 0.80, or when the parameter of chlorogallium phthalocyanine pigment was larger than 1.10, dark decay was not reduced as expected. In such a parameter A, chargeability is, probably, not good because the distortion in the molecular axis direction is large relative to the distortion in the n stacking direction. Hydroxygallium phthalocyanine pigment having parameter A of 0.80 or less is significantly effective in reducing dark decay particularly when integral width $\beta_2$ is larger than 0.40. This is probably because crystals grow in a direction in which conduction of heat carriers is hindered, as described above. In the examinations by the present inventors, there was not any correlation between the integral width (half width) of the strongest peak (in the present disclosure, at $2\theta_1$=7.4° for both the hydroxygallium phthalocyanine pigment and the chlorogallium phthalocyanine pigment) of the peaks on the lower angle side and dark decay characteristics.

The integral width β in the Scherrer equation is a value obtained by correcting the quotient of the peak area at the Bragg angle θ (2θ in X-ray diffraction spectra) divided by the peak height, using the reference material and correction formula described below. The positions, areas and heights of peaks can be determined by using profile parameters obtained by fitting with a profile function of the X-ray diffraction spectrum appropriately processed by, for example, eliminating the baseline. The profile functions that can be used here include Gaussian function, Lorentz function, Pearson VII function, Voigt function, pseudo-Voigt function, and functions asymmetric with respect to these functions (reference: Nakai, I. & Izumi, F., "Funmatsu X-sen kaiseki no jissai" (The Practice of Powder X-ray Analysis, in Japanese), pp. 120-123, Asakura Publishing Co., Ltd.) In the Examples of the present disclosure, a pseudo-Voigt function was used as the profile function.

As described above, a broadening of diffraction line width may result from two reasons: the apparatus; and the sample. The latter broadening results from crystallite size, lattice distortion, stacking misalignment, and so forth (reference: Nakai, I. & Izumi, F., "Funmatsu X-sen kaiseki no jissai" (The Practice of Powder X-ray Analysis, in Japanese), p. 63, Asakura Publishing Co., Ltd.) In order to accurately determine the line width resulting from the sample, in the present disclosure, the line width was corrected according to the following procedure.

A material having no lattice distortion is desirable as the reference material. For example, standard reference materials are available from NIST (National Institute of Standards and Technology). In the present disclosure, a stable organic compound, cytidine 4-amino-1-(3,4-dihydroxy-5(hydroxymethyl)oxolan-2-yl)pyrimidin-2-on, was used.

The correction is conducted according to the following procedure. First, the sample to be tested and the reference material were separately measured. Subsequently, a diffraction line width correction curve is prepared by using the peak widths of the reference material obtained by measurement as the broadening resulting from the apparatus, and the diffraction line width of the sample is corrected.

The diffraction line width correction curve will be described below. Since a diffraction line width is considered to be the convolution of an independent profile dominated by the crystallite size, the lattice distortion, and the X-ray diffractometer, the diffraction profile, in general, can be corrected by an approximation based on some assumptions.

In the analysis software program PDXL 2. 2 used herein, the diffraction line profile can be corrected by the following equation, with the assumption that the profile can be corrected by the Lorentz function wherein β represents the integral width proper, broadening depending on the crystallite size and the lattice distortion, and B represents the diffraction line width of the sample:

$$\beta = B \times y \quad (2\theta < 90°)$$

In the equation, correction coefficient y is a value represented by the following polynomial:

$$y = 0.991 - 0.01905\left(\frac{b}{B}\right) - 2.8205\left(\frac{b}{B}\right)^2 + 2.878\left(\frac{b}{B}\right)^3 - 1.0366\left(\frac{b}{B}\right)^4$$

In general, no reference material having diffraction angles coinciding with the diffraction angles of the sample is available. Accordingly, the diffraction angle dependence of integral width of the sample is determined, and then value b corresponding to B is calculated by a quadratic polynomial (by the method described in the application analysis user manual of the integrated powder X-ray analysis software program PDXL 2. 2).

The CuKα X-ray diffraction spectrum of a phthalocyanine pigment can be obtained by characteristic powder X-ray diffractometry. Molecular crystals such as phthalocyanine pigment tend to grow in a specific direction depending on the direction in which intermolecular forces act, the direction of plastic deformation applied for the crystal transformation, and, in the case of wet process, the solvent used. Accordingly, if a crystalline powder is measured on a plate, the reflection direction may be biased within the range of the volume of the sample irradiated with X-ray radiation because the particles of the sample powder are not randomly packed due to the crystal habit of the sample (reference: Nakai, I. & Izumi, F., "Funmatsu X-sen kaiseki no jissai" (The Practice of Powder X-ray Analysis, in Japanese), pp. 135-136, Asakura Publishing Co., Ltd.) This "preferred orientation" causes the ratio of peak intensities, which should not vary if crystals are in the same form, to vary. An integral width is the quotient of an integral intensity divided by the corresponding peak height. Therefore, the variation in intensity ratio often makes it difficult to accurately estimate the integral width. In the examination disclosed herein, from the viewpoint of eliminating such an influence, each sample is enclosed in a capillary, and the sample is irradiated with X-ray radiation while being rotated, thus suppressing the bias in reflection. Boro-silicate capillary (70 mm in length, 0.01 mm in thickness, 0.7 mm in inner diameter, manufactured by W. Muller) was used as the capillary (reference: Nakai, I. & Izumi, F., "Funmatsu X-sen kaiseki no jissai" (The Practice of Powder X-ray Analysis, in Japanese), pp. 119 and 140-142, Asakura Publishing Co., Ltd.)

The apparatus and measurement conditions for the powder X-ray diffraction analysis performed herein are as follows:

Apparatus: X-ray diffractometer RINT-TTR II, manufactured by Rigaku
X-ray tube: Cu
X-ray wavelength: Kα1
Tube voltage: 50 kV
Tube current: 300 mA
Scanning: 2θ scan
Scanning speed: 4.0°/min
Sampling interval: 0.02°
Start angle 2θ: 5.0°
Stop angle 2θ: 35.0°
Goniometer: Rotor horizontal goniometer (TTR-2)
Attachment: capillary sample turn table
Filter: none
Detector: Scintillation counter
Incident monochromator: used
Slit: Variable slit (parallel beam method)
Counter monochromator: not used
Divergence slit: open
Divergence vertical limit slit: 10.00 mm
Scattering slit: open
Receiving slit: open The present inventors have found through their researches that the two-step milling operation performed by applying a high pulverizing force in the early stage of crystal transformation and then applying a low pulverizing force for a long time enables the phthalocyanine pigment of the present disclosure to be efficiently produced while facilitating the control of the crystal transformation. The present inventors think that the reason why the two-step milling operation is suitable for producing the phthalocyanine pigment is as below.

Crystal transformation consists of the early stage in which the crystals of the crystalline particles are transformed throughout the pigment, and the later stage in which the crystalline particle size and the crystallite correlation length are varied while the crystals are being slightly transformed. The phthalocyanine pigment disclosed herein is produced by reducing parameter A, or the ratio of the crystallite correlation length in the π stacking direction to the crystallite correlation length in the molecular axis direction in the later stage of the crystal transformation. However, it is generally difficult to apply a pulverizing force in the first stage of crystal transformation so as to reduce the ratio A of the crystallite correlation length in the π stacking direction to the crystallite correlation length in the molecular axis direction. This is because continuous application of a high pulverizing force for crystal transformation in the first stage increases both the energy that can break the structure of phthalocyanine molecules in the π stacking direction and the energy that can break the structure in the molecular axis direction; hence, parameter A representing anisotropy in crystalline alignment in the two directions cannot be reduced. In contrast, if a low pulverizing force is continuously applied for crystal transformation in the first stage, the crystalline particles are kept coarse with a small specific surface area throughout the crystal transformation, hindering the solvent from permeating into the crystalline particles. Accordingly, the molecule of the solvent is not likely to enter the space between opposing planes of planar phthalocyanine molecules, and the solvent becomes unable to help the structure of phthalocyanine molecules to break more easily in the π stacking direction than in the molecular axis direction. Parameter A is therefore not reduced.

The above-mentioned two-step milling operation reduces the size of the crystalline particles to the same level in the first stage of crystal transformation and then applies a low pulverizing force to the phthalocyanine pigment brought into a state where the phthalocyanine molecules are easily cut in the π stacking direction by the effect of the solvent described above, thus gradually reducing parameter A. As is clear from this mechanism, if the magnitudes of the pulverizing forces are reversed in the two-step milling operation, that is, if a low pulverizing force is applied in the early stage of the crystal transformation and then a high pulverizing force is applied for a long time, the phthalocyanine pigment of the present disclosure cannot be obtained. It is important to reduce the crystalline particle size to the same level to such an extent that the solvent for transformation can permeate into the crystalline particles, in the early stage in which the crystals of the crystalline particles are transformed throughout the pigment. Therefore, a two-step milling operation where the early stage proceeds in a dry process without using a solvent required for crystal transformation cannot produce the phthalocyanine pigment of the present disclosure.

Also, if the water content after vacuum drying in the pigment before crystal transformation is appropriately controlled, the phthalocyanine pigment of the present disclosure may be produced by a one-step milling operation. The reason why the water content can be a factor of controlling the crystal transformation is that since the penetration of the solvent for crystal transformation is enhanced by removing the water adsorbed to the surfaces of the pigment particles or to the interfaces between the particles to some extent, a fracture becomes likely to occur in such a manner as the braking in the π stacking direction occurs when a pulverizing force is applied. Thus, parameter A can be gradually reduced without applying a high pulverizing force in the first state of the two-step transformation.

In crystal transformation in a wet process, the effect of the water contained in the solvent cannot be removed. Accordingly, the water content may be controlled as the water content in the system of the liquid subjected to transformation. In this instance, the water content in the system is determined by measurements of the water content in the vacuum-dried pigment before crystal transformation and the water content in the solvent before being mixed with the pigment, and by calculation using these water contents and the ratio between the pigment and the solvent in the mixture. For example, in the present disclosure, when the water content in the system in the early stage comes to, for example, about 150 ppm to 1,500 ppm in the case of transformation using a ball mill, or about 1,500 ppm to 3,000 ppm in the case of transformation using a sand mill, a pigment satisfying the requirement for parameter A can be obtained.

The content of water adsorbed to the surfaces of the pigment particles may be measured with a Karl Fischer moisture meter.

Charge Generating Layer

In the present disclosure, the charge generating layer is formed to a thickness larger than 200 nm to ensure good dark decay characteristics while improving image quality by reducing interference fringes and nonuniformity in the layer. In view of this, to control the evaluation parameter A disclosed herein to 0.8 or more, the feature of the charge generating layer is taken into account, as well as the feature in terms of the r value of the phthalocyanine pigment, as described above.

The charge generating layer disclosed herein contains a charge generating material with a volume ratio of P to the total volume of the charge generating layer and has a thickness of d (nm). These features will now be described in detail.

For determining the volume ratio P of the charge generating layer in the structure of the electrophotographic photosensitive member, the charge generating layer may be extracted from the electrophotographic photosensitive member by FIB and thus observed by FIB-SEM Slice & View. The phthalocyanine pigment and the binder resin are distinguished by the difference between their FIB-SEM Slice & View contrasts. Thus, the volume ratio P can be determined.

The ratio P of the volume of the charge generating material to the total volume of the charge generating layer (hereinafter referred to as volume ratio P) may be in the range of 0.40 to 0.75, and, from the viewpoint of increasing the definition of images in terms of discrete dot reproductivity and thin line reproductivity, may be in the range of 0.58 to 0.75. If the volume ratio P is less than 0.40, the molecules of the phthalocyanine pigment acting as an electrical conductor in the charge generating layer are not likely to come into contact with each other, reducing electrical conductivity. Consequently, the sensitivity is reduced, and a severe memory phenomenon occurs. On the other hand, if the volume ratio P is more than 0.75, the phthalocyanine pigment is not likely to disperse sufficiently in the charge generating layer and is likely to form aggregates that can cause dot defects (blue spots) and fogging. A low volume ratio of the binder resin results in a reduced adhesion of the charge generating layer to the adjacent layer, causing a problem with durability, such as a separation of the charge generating layer during use in an electrophotographic process. By controlling the volume ratio P in the above-mentioned range, the reduction in sensitivity and the memory phenomenon which result from the electrical conductivity of the charge generating layer can be suppressed while sufficient dispersion and good durability are achieved.

The thickness d of the charge generating layer can be determined by FIB-SEM Slice & View. For simplicity, the thickness d may be determined by using the average specific gravity and the weight of the charge generating layer. In the present disclosure, the thickness of the charge generating layer is larger than 200 nm and may be larger than 220 nm.

Electrophotographic Photosensitive Member

Figure 3:
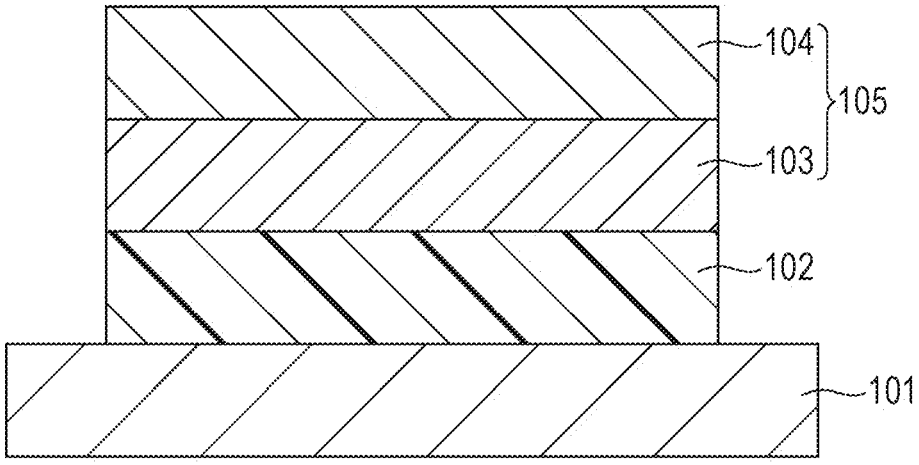
FIG. 3 is the multilayer structure of an electrophotographic photosensitive member according to an embodiment of the present disclosure.

The electrophotographic photosensitive member according to an embodiment of the present disclosure includes a support and a multilayer photosensitive layer over the support. FIG. 3 is an illustrative representation of the multilayer structure of an electrophotographic photosensitive member. The electrophotographic photosensitive member shown in FIG. 3 includes a support 101, an undercoat layer 102, and a multilayer photosensitive layer 105 including a charge generating layer 103 and a charge transport layer 104. In an embodiment, the undercoat layer 102 is not necessarily provided.

Support

The support may be electrically conductive (electroconductive support), and may be made of a metal, such as aluminum, iron, copper, gold, stainless steel, nickel, or an alloy thereof. An insulating support provided with an electroconductive coating film over the surface thereof may be used. The insulating support may be made of a plastic, such as a polyester resin, a polycarbonate resin, or a polyimide resin, or glass or paper. The electroconductive coating film may be a metal thin film made of, for example, aluminum, chromium, silver, or gold, a thin film of any other electroconductive material such as indium oxide, tin oxide, or zinc oxide, or a thin film of an electroconductive ink containing silver nanowires.

The support may be in the form of a cylinder, a film, or the like. The cylindrical aluminum support is superior in mechanical strength, electrophotographic properties, and cost. A plain pipe, as it is, may be used as the support, or the plain pipe may be surface-treated to improve the electrical characteristics or reduce interference fringes by for example, physical treatment, such as cutting, honing, or blasting, or anodization or other chemical treatment using an acid or the like. A plain pipe support treated by physical treatment so as to have a ten-point surface roughness $R_{zjis}$, specified in JIS B0601: 2001, of 0.8 μm or more, such as cutting, honing, or blasting, can reduce interference fringes effectively.

Electroconductive Layer

The electrophotographic photosensitive member may optionally include an electroconductive layer between the support and the photosensitive layer to cover the roughness of or defects at the support or reduce interference fringes. Particularly in the case of using a plain pipe as the support, forming the electroconductive layer is a simple way to reduce interference fringes. This is very advantageous in terms of productivity and cost efficiency.

The electroconductive layer may be formed by applying a coating liquid prepared by dispersing electroconductive particles and a binder resin in a solvent to form a coating film and drying the coating film. For preparing the dispersion liquid, for example, a paint shaker, a sand mill, a ball mill, or a high-speed liquid collision disperser may be used.

Examples of the electroconductive particles include carbon black, acetylene black, powder of metal such as aluminum, nickel, iron, Nichrome, copper, zinc, or silver, and powder of a metal compound such as tin oxide, indium oxide, titanium oxide, or barium sulfate. The binder resin may be a polyester resin, a polycarbonate resin, a polyvinyl butyral resin, an acrylic resin, a silicone resin, an epoxy resin, a melamine resin, a urethane resin, a phenol resin, or an alkyd resin. Examples of the solvent of the coating liquid include ethers, such as tetrahydrofuran, dioxane, ethylene glycol monomethyl ether, and propylene glycol monomethyl ether; alcohols, such as methanol, ethanol, and isopropanol; ketones, such as acetone, methyl ethyl ketone, and cyclohexanone; esters, such as methyl acetate and ethyl acetate; and aromatic hydrocarbons, such as toluene and xylene. The coating liquid for the electroconductive layer may further contain roughing particles.

The thickness of the electroconductive layer may be in the range of 5 μm to 40 μm, such as in the range of 10 μm to 30 μm, from the viewpoint of reducing interference fringes and covering the defects at the surface of the support.

Undercoat Layer

An undercoat layer acting as a barrier or an adhesive may optionally be disposed on the support or the electroconductive layer. The undercoat layer may be formed by applying a coating liquid prepared by dissolving a resin in a solvent to form a coating film and drying the coating film.

Examples of the resin as the material of the undercoat layer include acrylic resin, allyl resin, alkyd resin, ethyl cellulose resin, methyl cellulose resin, ethylene-acrylic acid copolymer, epoxy resin, casein resin, silicone resin, gelatin resin, phenol resin, butyral resin, polyacrylate resin, polyacetal resin, polyamide-imide resin, polyamide resin, polyallyl ether resin, polyimide resin, polyurethane resin, polyester resin, polyethylene resin, polyethylene oxide resin, polycarbonate resin, polystyrene resin, polysulfone resin, polyvinyl alcohol resin, polybutadiene resin, polypropylene resin, urea resin, agarose resin, and cellulose resin. Among these, polyamide resin is advantageous for acting as a barrier or an adhesive.

The thickness of the undercoat layer may be in the range of 0.3 μm to 5 μm. The undercoat layer may have the commutation function of causing photo carriers to flow to the support. In the case of a negative charging type, the undercoat layer is an electron transport film containing an electron transporting material and acts so that electrons flow to the support from the photosensitive layer. More specifically, the undercoat layer may be defined by a film formed by hardening or curing an electron transporting material or a composition containing an electron transporting material, a film formed by drying a coating of a coating liquid prepared by dissolving an electron transporting material, or a film containing an electron transporting pigment. Beneficially, the undercoat layer is a cured or hardened film from the viewpoint of preventing the elution of the electron transporting material to the charge generating layer. In some embodiments, the cured film may be formed by curing the composition further containing a crosslinking agent. More beneficially, the composition contains a crosslinking agent and a resin. In some embodiments, the electron transporting material and the resin in the cured film may be an electron transporting compound having a polymerizable functional group and a resin having a polymerizable functional group, respectively. Examples of the polymerizable functional group include hydroxy, thiol, amino, carboxy, and methoxy. The crosslinking agent may be a compound polymerizable or crosslinkable with one or both of the electron transporting compound having a polymerizable functional group and the resin having a polymerizable functional group.

Charge Generating Layer

The charge generating layer having a thickness of more than 200 nm is formed by applying a coating liquid prepared by dispersing the phthalocyanine pigment as the charge generating material and a binder resin in a solvent to form a coating film and drying the coating film.

The coating liquid for forming the charge generating layer may be prepared by dispersing only the charge generating material in a solvent and then adding a binder resin to the dispersion, or by dispersing the charge generating material and the binder resin together in the solvent.

For dispersing the materials, a disperser may be used. Examples of the disperser include media dispersers, such as a sand mill and a ball mill, liquid collision dispersers, and ultrasonic dispersers. Incidentally, the crystallite correlation length of the crystals in the charge generating layer of the electrophotographic photosensitive member formed in each Example or Comparative Example was estimated. More specifically, the charge generating layer was removed and pulverized into powder, followed by dispersion using ultrasonic waves. The powder was subjected to powder X-ray diffraction analysis, and the crystallite correlation length was estimated by the above-described calculation. The estimated crystallite correlation length was compared with the crystallite correlation length of the phthalocyanine pigment before being dispersed in the coating liquid, estimated by power X-ray diffraction analysis and the above-described calculation. Thus, it has been confirmed that the crystallite correlation length of the phthalocyanine pigment of the present disclosure is not varied by the dispersion operation performed in the present disclosure.

The binder resin used in the charge generating layer may be an insulating resin, and examples thereof include polyvinyl butyral resin, polyvinyl acetal resin, polyarylate resin, polycarbonate resin, polyester resin, polyvinyl acetate resin, polysulfone resin, polystyrene resin, phenoxy resin, acrylic resin, polyacrylamide resin, polyvinyl pyridine resin, urethane resin, agarose resin, cellulose resin, casein resin, polyvinyl alcohol resin, polyvinylpyrrolidone resin, polyvinylidene chloride resin, acrylonitrile copolymers, and polyvinyl benzal resin. Organic photoconductive polymers may also be used, such as poly-N-vinyl carbazol, polyvinyl anthracene, and polyvinyl pyrene. The binder resin may be composed of a single resin, or may be a mixture or a copolymer of two or more resins.

Examples of the solvent used in the coating liquid for forming the charge generating layer include toluene, xylene, tetralin, chlorobenzene, dichloromethane, chloroform, trichloroethylene, tetrachloroethylene, carbon tetrachloride, methyl acetate, ethyl acetate, propyl acetate, methyl formate, ethyl formate, acetone, methyl ethyl ketone, cyclohexanone, diethyl ether, dipropyl ether, propylene glycol monomethyl ether, dioxane, methylal, tetrahydrofuran, water, methanol, ethanol, n-propanol, isopropanol, butanol, methyl cellosolve, methoxypropanol, dimethylformamide, dimethylacetamide, and dimethyl sulfoxide. These solvents may be used singly or in combination.

Phthalocyanine Pigment

The charge generating material used herein is hydroxygallium phthalocyanine pigment or chlorogallium phthalocyanine pigment (these two pigments are hereinafter integrally referred to as phthalocyanine pigment). The molecule of these pigments may have axial ligand or a substituent.

In the present disclosure, the hydroxygallium phthalocyanine pigment exhibits a CuKα X-ray diffraction spectrum having peaks at Bragg angles 2θ of 7.4°±0.3° and 28.2°±0.3°. Also, the chlorogallium phthalocyanine pigment exhibits a CuKα X-ray diffraction spectrum having peaks at Bragg angles 2θ±0.2° of 7.4°, 16.6°, 25.5°, and 28.4°.

Beneficially, the crystalline particles of the phthalocyanine pigment contain an amide compound represented by the following formula (A1):

(A1)

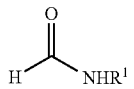

wherein R' represents a group selected from the group consisting of methyl, propyl, and vinyl.

Examples of the amide compound of formula (A1) include N-methylformamide, N-propylformamide, and N-vinylformamide.

The content of the amide compound of formula (A1) in the crystalline particles may be in the range of 0.1% by mass to 3.0% by mass relative to the mass of the crystalline particles and is beneficially in the range of 0.1% by mass to 1.4% by mass. When the amide compound content is in the range of 0.1% by mass to 3.0% by mass, the size of the crystalline particles is not excessively reduced, and the standard deviation of the particle size distribution is reduced. Thus, the crystalline particles have similar particle sizes to each other and a controlled balance between the particle size and the crystallite correlation length. Consequently, the evaluation parameter disclosed herein can be increased.

The phthalocyanine pigment containing the amide compound of formula (A1) in the crystalline particles is produced in a process of crystal transformation performed by wet milling of a phthalocyanine pigment produced by acid pasting and the amide compound of formula (A1).

If a dispersant is used for this wet milling, the mass of the dispersant may be 10 to 50 times that of the phthalocyanine pigment. Examples of the solvent used for the wet milling include amide-based solvents, such as N,N-dimethylformamide, N,N-dimethylacetamide, a compound represented by formula (A1), N-methylacetamide, and N-methylpropionamide; halogen-based solvents, such as chloroform; ether-based solvents, such as tetrahydrofuran; and sulfoxide-based solvents, such as dimethyl sulfoxide. The mass of the solvent to be used may be 5 to 30 times that of the phthalocyanine pigment.

The present inventors found that if a compound represented by formula (A1) is used as the solvent in the process of crystal transformation for producing the phthalocyanine pigment in the crystallite form disclosed herein, it takes a long time to transform the crystals of the pigment. For example, the time for the crystal transformation in the case of using N-methylformamide as the solvent is several times as long as that in the case of using N,N-dimethylformamide. Since the crystal transformation takes a long time, a time is given to reduce the size of the crystalline particle to the same level to some extent by the time when the crystal transformation is completed, facilitating the production of the phthalocyanine pigment disclosed herein.

Charge Transport Layer

The charge transport layer is formed by applying a coating liquid prepared by dispersing a charge transporting material and optionally a binder resin in a solvent to form a coating film and drying the coating film.

Examples of the charge transporting material include triarylamine compounds, hydrazone compounds, stilbene compounds, pyrazoline compounds, oxazole compounds, thiazole compounds, and triallylmethane compounds. The charge transporting material may be a polymer having a group derived from these compounds in the main chain or a side chain thereof. Triarylamine compounds, styryl compounds, and benzidine compounds are beneficial as the charge transporting material, and triarylamine compounds are more beneficial. These and those charge transporting materials may be used singly or in combination.

The binder resin used in the charge transport layer may be an insulating resin, and examples thereof include polyvinyl butyral resin, polyvinyl acetal resin, polyarylate resin, polycarbonate resin, polyester resin, polyvinyl acetate resin, polysulfone resin, polystyrene resin, phenoxy resin, polyvinyl acetate resin, acrylic resin, polyacrylamide resin, polyamide resin, polyvinyl pyridine resin, urethane resin, epoxy resin, agarose resin, cellulose resin, casein resin, polyvinyl alcohol resin, polyvinylpyrrolidone resin, polyvinylidene chloride resin, acrylonitrile copolymers, and polyvinyl benzal resin. Organic photoconductive polymers may also be used, such as poly-N-vinyl carbazol, polyvinyl anthracene, and polyvinyl pyrene. Among these and those resins, polycarbonate resin and polyarylate resin are beneficial. The binder resin may be composed of a single resin, or may be a mixture or a copolymer of two or more resins. The copolymer may be in any form, such as block copolymer, random copolymer, or alternating copolymer. The weight average molecular weight (Mw) of the binder resin may be in the range of 10,000 to 300,000.

The charge transporting material content in the charge transport layer may be in the range of 20% by mass to 80% by mass, such as in the range of 30% by mass to 60% by mass, relative to the total mass of the charge transport layer.

The thickness of the charge transport layer may be in the range of 5 μm to 40 μm.

Protective Layer

A protective layer may optionally be disposed on the photosensitive layer. The protective layer may be formed by applying a coating liquid prepared by dissolving a resin in a solvent to form a coating film and drying the coating film. Alternatively, the protective layer may be formed by heating the coating film or curing the coating film by, for example, electron beam or ultraviolet light irradiation.

Examples of the resin used in the protective layer include polyvinyl butyral resin, polyester resin, polycarbonate resin (polycarbonate Z, modified polycarbonate, etc.), nylon resin, polyimide resin, polyacrylate resin, polyurethane resin, styrene-butadiene copolymer, styrene-acrylic acid copolymer, and styrene-acrylonitrile copolymer.

From the viewpoint of enabling the protective layer to transport charge carriers, the protective layer may be formed by curing a monomer capable of transporting charge carriers by a polymerization reaction or a crosslinking reaction. For example, the protective layer may be formed by polymerizing or crosslinking a charge-transportable compound having a chain-polymerizable functional group to cure the compound.

The protective layer may contain electroconductive particles, a UV absorbent, or lubricative particles such as fluorine-containing organic particles. The electroconductive particles may be metal oxide particles, such as zinc oxide particles. The thickness of the protective layer may be in the range of 0.05 μm to 20 μm.

The application of the coating liquid for each layer may be performed by dipping, spray coating, spinner coating, bead coating, blade coating, beam coating, or any other coating technique. In an embodiment, dipping may be employed from the viewpoint of efficiency and productivity.

Process Cartridge and Electrophotographic Apparatus

Figure 4:
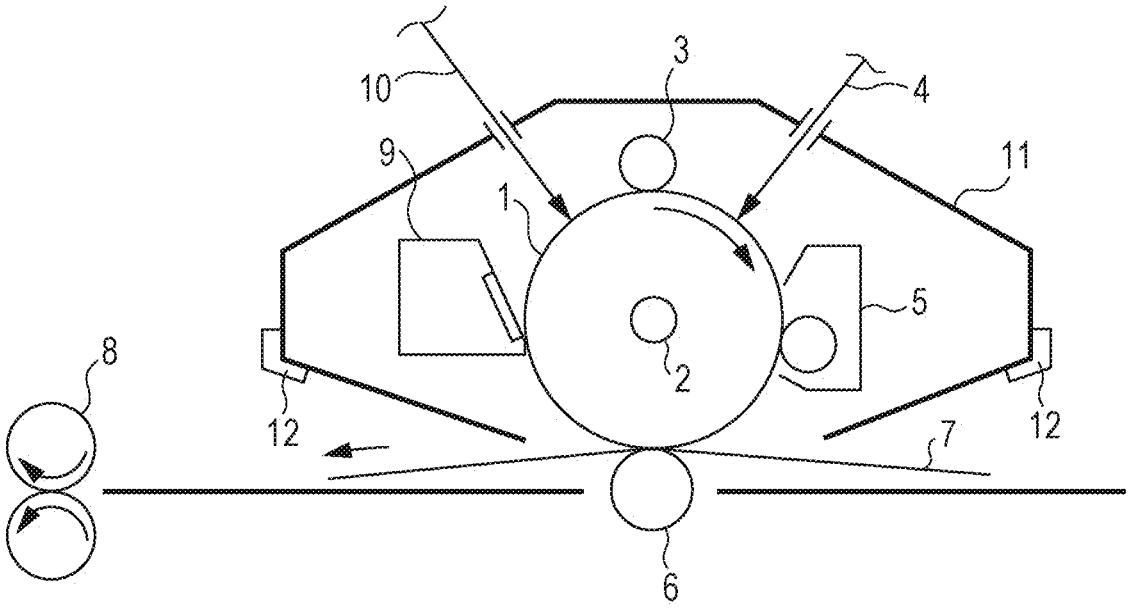
FIG. 4 is a schematic view of the structure of an electrophotographic apparatus provided with a process cartridge including an electrophotographic photosensitive member according to an embodiment of the present disclosure.

FIG. 4 is a schematic view of the structure of an electrophotographic apparatus provided with a process cartridge including an electrophotographic photosensitive member. This electrophotographic photosensitive member 1, which is cylindrical (drum-shaped), is driven for rotation on a shaft 2 in the direction indicated by the arrow at a predetermined peripheral speed (process speed).

When driven for rotation, the surface of the electrophotographic photosensitive member 1 is charged to a predetermined positive or negative potential with a charging device 3. Subsequently, an electrostatic latent image corresponding to targeted image information is formed on the surface of the charged electrophotographic photosensitive member 1 by irradiation with exposure light 4 from an exposure device (not shown). The exposure light 4 has been modulated in intensity according to the time-series electric digital image signals of the targeted image information outputted from the exposure device, such as a slit exposure device or a laser beam scanning exposure device.

The electrostatic latent image formed on the surface of the electrophotographic photosensitive member 1 is developed (normally developed or reversely developed) into a toner image with a toner contained in a developing device 5. The toner image on the surface of the electrophotographic photosensitive member 1 is transferred to a transfer medium 7 by a transfer device 6. At this time, a bias voltage having an opposite polarity to the charge of the toner is applied to the transfer device 6 from a bias source (not shown). When the transfer medium 7 is paper, the medium 7 is fed to the portion between the electrophotographic photosensitive member 1 and the transfer device 6 from a paper feeder (not shown) in synchronization with the rotation of the electrophotographic photosensitive member 1.

The transfer medium 7 to which the toner image has been transferred from the electrophotographic photosensitive member 1 is separated from the surface of the electrophotographic photosensitive member 1 and then conveyed to a fixing device 8 for fixing the toner image, thus being ejected as an image-formed article (printed matter or copy) from the electrophotographic apparatus.

The surface of the electrophotographic photosensitive member 1 from which the toner image has been transferred to the transfer medium 7 is cleaned with a cleaning device 9 to remove therefrom the toner or the like remaining after transfer. A recently developed cleanerless system may be used. In this system, the toner remaining after transfer is directly removed by a developing device or the like. Then, the surface of the electrophotographic photosensitive member 1 is pre-exposed to pre-exposure light 10 from a pre-exposure device (not shown) to remove static electricity before being used again for forming images. If the charging device 3 is a contact charging type using a charging roller or the like, pre-exposure device is not necessarily required.

In an embodiment of the present disclosure, some of the components of the electrophotographic apparatus including the electrophotographic photosensitive member 1, the charging device 3, the developing device 5, and the cleaning device 9 are integrated in a container as a process cartridge. The process cartridge may be removably mounted to the body of the electrophotographic apparatus. For example, at least one selected from among the charging device 3, the developing device 5, and the cleaning device 9 is integrated with the electrophotographic photosensitive member 1 into a cartridge. The cartridge may be guided by a guide 12 such as a rail, thus being used as a process cartridge 11 removable from the body of the electrophotographic apparatus.

If the electrophotographic apparatus is a copy machine or a printer, the exposure light 4 may be light reflected from or transmitted through an original image. Alternatively, the exposure light 4 may be light emitted by laser beam scanning operation according to the signals generated by reading the original image with a sensor, or light emitted from an LED array or a liquid crystal shutter array driven according to such signals.

The electrophotographic photosensitive member 1 disclosed herein can be widely applied to electrophotographic applications in the fields of, for example, laser beam printers, CRT printers, LED printers, FAX machines, liquid crystal printers, and laser plate making.

Electrophotographic Process

When a photosensitive material is used in an electrophotographic process in practice, it may be desired to increase only the S/N ratio of the difference (latent image contrast) between the charged potential of the non-image area and the exposure potential of the image to as high a level as possible in view of image quality. By increasing the S/N ratio to stabilize the latent image contrast, both the difference between development potential and exposure potential (this difference is referred to development contrast) and the difference between charged potential and development potential (this difference is referred to as Vback) are stabilized. When the development contrast is stable, the amount of toner in the image area becomes stable. Also, when the Vback is stable, fogging over the non-image area is reduced. Thus, increasing the S/N ratio of latent image contrast leads to improved image quality such as dot reproductivity.

However, if the charge potential is set high from the viewpoint of ensuring a stable latent image contrast, the intensity of the electric field applied to the photosensitive layer increases, resulting in increased dark decay.

The phthalocyanine pigment satisfying the requirement for parameter A can function to reduce dark decay even under conditions where the charged potential is high. Particularly when the absolute value of the charged potential is higher than 500 V, and beneficially when the latent image contrast is higher than 400 V, both a good dot reproduction and a reduced dark decay can be achieved.

The reason why dark decay is increased when a high electric field is applied to the photosensitive layer is not clear but may be an electron avalanche in the charge generating layer. Under the condition of a high electric field, charges generated in the charge generating layer repetitively collide with each other in the layer, diffusing electron avalanches that exponentially increase charges. The electron avalanche diffuses along the electric field. Thus, the higher the electric field, the worse the dark decay resulting from electron avalanches. In practice, there is a threshold electric field for electron avalanches, and the threshold electric field varies depending on the volume ratio of the charge generating material to the charge generating layer (conductive paths between pigment particles) and the crystal structure of the charge generating material (conductive paths within the pigment particles). Accordingly, the present inventors assume that crystal distortion of the phthalocyanine pigment specified by the parameter disclosed herein increases the threshold electric field for electron avalanches, ensuring good dark decay characteristics with a high latent image contrast in use in a high electric field.

EXAMPLES

The subject matter of the present disclosure will be further described in detail with reference to the following examples.

In the following description, the term "part(s)" refers to "part(s) by mass". It should be appreciated that the subject matter is not limited to the following Examples. The thicknesses of each layer of the electrophotographic photosensitive members of the Examples and Comparative Examples were determined by measurement using an eddy current thickness meter Fischerscope (manufactured by Fischer) or by calculation using specific gravity and mass per unit area.

Synthesis of Phthalocyanine Pigments

Synthesis Example 1

A reactor was charged with 5.46 parts of o-phthalonitrile and 45 parts of α-chloronaphthalene and was then heated to and kept at 30° C. in an atmosphere of nitrogen flow. Subsequently, 3.75 parts of gallium trichloride was added into the reactor at this temperature (30° C.). The water content in the resulting mixture at this time was 150 ppm. Then, the mixture was heated to 200° C. Subsequently, the mixture was subjected to a reaction at 200° C. for 4.5 hours in an atmosphere of nitrogen flow, followed by cooling to 150° C. Then, the reaction product was filtered out. The resulting filtration product was dispersed in N,N-dimethylformamide and washed at 140° C. for 2 hours, followed by filtration. The resulting filtration product was washed with methanol and dried to yield a chlorogallium phthalocyanine pigment with a yield of 71%.

Synthesis Example 2

In 139.5 parts of concentrated sulfuric acid was dissolved, at 10° C., 4.65 parts of the chlorogallium phthalocyanine pigment produced in Synthesis Example 1. The solution was dropped into 620 parts of ice water with stirring for precipitation, and the precipitate was filtered using a filter press under reduced pressure. For this filtration, No. 5C filter (manufactured by ADVANTEC) was used as the filter. The resulting wet cake (filtration product) was dispersed and washed in 2% ammonia solution for 30 minutes and then filtered using a filter press. Subsequently, the resulting wet cake (filtration product) was dispersed and washed in ion exchanged water and then filtered using a filter press. This operation was repeated three times. Finally, the product was freeze-dried to yield a hydroxygallium phthalocyanine pigment (solids content: 23%, hydrous hydroxygallium phthalocyanine pigment) with a yield of 97%.

Synthesis Example 3

In a dryer HYPER-DRY HD-06R (oscillation frequency: 2455 MHz±15 MHz, manufactured by Biocon), 6.6 kg of the hydroxygallium phthalocyanine pigment produced in Synthesis Example 2 was dried as below.

The cake of the hydroxygallium phthalocyanine pigment removed from the filter press (hydrous cake thickness: 4 cm or less) was placed on a dedicated circular plastic tray, and the dryer was set so that the internal wall temperature would be 50° C. and that infrared radiation would be off. For microwave irradiation, the degree of vacuum in the dryer was set in the range of 4.0 kPa to 10.0 kPa by adjusting the vacuum pump and the leakage valve.

In the first step for the drying, the hydroxygallium phthalocyanine pigment was irradiated with microwaves of 4.8 kW for 50 minutes. After temporarily interrupting the microwave radiation, the dryer was evacuated to a high vacuum of 2 kPa or less with the leakage valve closed. At this time, the solids content of the hydroxygallium phthalocyanine pigment was 88%. In the second step, the degree of vacuum (internal pressure of the dryer) was returned to the above-set range (4.0 kPa to 10.0 kPa) by adjusting the leakage valve. Then, the hydroxygallium phthalocyanine pigment was irradiated with microwaves of 1.2 kW for 5 minutes. After temporarily interrupting the microwave radiation, the dryer was evacuated to a high vacuum of 2 kPa or less with the leakage valve closed. This second step was repeated once (twice in total). At this time, the solids content of the hydroxygallium phthalocyanine pigment was 98%. Furthermore, in the third step, irradiation with microwaves was performed in the same manner as in the second step, except that the power of the microwaves was varied from 1.2 kW to 0.8 kW. This third step was repeated once (twice in total). Furthermore, in the fourth step, the degree of vacuum (internal pressure of the dryer) was returned to the above-set range (4.0 kPa to 10.0 kPa) by adjusting the leakage valve. Then, the hydroxygallium phthalocyanine pigment was irradiated with microwaves of 0.4 kW for 3 minutes. After temporarily interrupting the microwave radiation, the dryer was evacuated to a high vacuum of 2 kPa or less with the leakage valve closed. This fourth step was repeated seven times (eight times in total). Thus, 1.52 kg of hydroxygallium phthalocyanine pigment (crystals) with a water content of 1% or less was produced over a period of three hours in total.

Synthesis Example 4

With 200 parts of hydrochloric acid (35% by mass in terms of hydrogen chloride) of 23° C. in temperature was mixed 10 parts of the hydroxygallium phthalocyanine pigment produced in Synthesis Example 2. The mixture was stirred with a magnetic stirrer for 90 minutes. After mixing hydrochloric acid, the ratio of the hydrogen chloride to the hydroxygallium phthalocyanine was 118 mol to 1 mol. After being stirred, the mixture was dropped into 1,000 parts of ion exchanged water cooled with ice water, followed by stirring with a magnetic stirrer for 30 minutes. The resulting mixture was filtered under reduced pressure. For this filtration, No. 5C filter (manufactured by ADVANTEC) was used as the filter. Then, the filtration product was dispersed and washed in 23° C. ion exchanged water four times. Thus, 9 parts of a chlorogallium phthalocyanine pigment was produced.

Synthesis Example 5

In 100 g of α-chloronaphthalene, 5.0 g of o-phthalodinitrile and 2.0 g of titanium tetrachloride were stirred for 3 hours with heating at 200° C. Then, the mixture was cooled to 50° C. to precipitate crystals. The precipitate was separated by filtration to yield paste of a dichlorotitanium phthalocyanine. Subsequently, the paste was stirred and washed in 100 mL of N,N-dimethylformamide heated to 100° C. and then washed in 100 mL of 60° C. methanol twice, followed by filtration. Furthermore, the resulting paste was stirred in 100 mL of deionized water at 80° C. for 1 hour, and the liquid was subjected to filtration to yield 4.3 g of a blue titanyl phthalocyanine pigment.

Then, the resulting pigment was dissolved in 30 mL of concentrated sulfuric acid, and the solution was dropped into 300 mL of 20° C. deionized water with stirring for precipitation. The precipitate was filtered out and sufficiently washed with water to yield an amorphous titanyl phthalocyanine pigment. In 100 mL of methanol was suspended 4.0 g of the resulting amorphous titanyl phthalocyanine pigment at room temperature (22° C.) for 8 hours. The suspension was filtered, and the filtration product was dried under reduced pressure to yield a low-crystallinity titanyl phthalocyanine pigment.

Synthesis Example 6

To 230 parts of dimethyl sulfoxide were added 30 parts of 1,3-diiminoisoindoline and 9.1 parts of gallium trichloride. The materials were subjected to a reaction at 160° C. for 6 hours with stirring to yield a purple-red pigment. The resulting pigment was washed with dimethyl sulfoxide and ion exchanged water in that order and then dried to yield 28 parts of a chlorogallium phthalocyanine pigment.

Synthesis Example 7

The solution of 10 parts of the chlorogallium phthalocyanine pigment produced in the foregoing Synthesis Example 6 in 300 parts of 60° C. sulfuric acid (concentration: 97%) was dropped into the mixed solution of 600 parts of 25% ammonia water and 200 parts of ion exchanged water. After being collected by filtration, the precipitated pigment was washed with N,N-dimethylformamide and ion exchanged water and then dried to yield 8 parts of a hydroxygallium phthalocyanine pigment.

Synthesis Example 8

To 100 mL of α-chloronaphthalene were added 10 g of gallium trichloride and 29.1 g of o-phthalonitrile in an atmosphere of nitrogen flow, and the materials were subjected to a reaction at 200° C. for 24 hours. Then, the reaction product was collected by filtration. The filtration product, which was in the form of wet cake, was dispersed in N,N-dimethylformamide at 150° C. for 30 minutes, followed by filtration. The resulting filtration product was washed with methanol and dried to yield a chlorogallium phthalocyanine pigment with a yield of 83%.

In 50 parts of concentrated sulfuric acid was dissolved 2 parts of this chlorogallium phthalocyanine pigment. After being stirred for 2 hours, the solution was dropped into the ice-cooled mixed solution of 170 mL of distilled water and 66 mL of concentrated ammonia solution to yield a precipitate. After being washed with distilled water, the precipitate was dried to yield 1.8 parts of a hydroxygallium phthalocyanine pigment.

Synthesis Example 9

A reaction of 31.8 parts of phthalonitrile, 10.1 parts of gallium trimethoxide, and 150 mL of methylene glycol was performed at 200° C. for 24 hours in an atmosphere of nitrogen flow. Then, the reaction product was collected by filtration. The resulting product, which was in the form of wet cake, was washed with N,N-dimethylformamide and methanol in that order and then dried to yield 25.1 parts of a gallium phthalocyanine pigment.

In 50 parts of concentrated sulfuric acid was dissolved 2 parts of this chlorogallium phthalocyanine pigment. After being stirred for 2 hours, the solution was dropped into the ice-cooled mixed solution of 170 mL of distilled water and 66 mL of concentrated ammonia solution to yield a precipitate. After being washed with distilled water, the precipitate was dried to yield 1.8 parts of a hydroxygallium phthalocyanine pigment.

Synthesis Example 10

To 230 parts of dimethyl sulfoxide were added 30 parts of 1,3-diiminoisoindoline and 9.1 parts of gallium trichloride. The materials were subjected to a reaction at 160° C. for 4 hours with stirring to yield a purple-red pigment. The resulting pigment was washed with dimethyl sulfoxide and ion exchanged water in that order. The resulting wet cake was vacuum-dried at 80° C. for 24 hours to yield 28 parts of a chlorogallium phthalocyanine pigment.

Preparation of Photosensitive Members

Photosensitive Member Production Example 1

Support

An aluminum cylinder of 24 mm in diameter and 257 mm in length was used as a support (cylindrical support).

Electroconductive Layer

Then, in a ball mill were dispersed 60 parts of tin oxide-coated barium sulfate particles (PASTRAN PC1, produced by "Mitsui Mining & Smelting), 15 parts of titanium oxide particles (TITANIX JR, produced by Tayca), 43 parts of resol-type phenol resin (PHENOLITE J-325, produced by DIC, solids content: 70% by mass), 0.015 part of silicone oil (SH28PA, produced by Dow Corning Toray), 3.6 parts of silicone resin particles (TOSPEARL 120, produced by Momentive Performance Materials), 50 parts of 2-methoxy-1-propanol, and 50 parts of methanol for 20 hours to yield a coating liquid for the electroconductive layer. This coating liquid was applied to the surface of the support by dipping. The resulting coating film was cured by heating at 145° C. for 1 hour to yield a 20 μm-thick electroconductive layer.

Undercoat Layer

Next, 25 parts of N-methoxymethylated nylon 6 (Toresin EF-30T, produced by Nagase Chemtex) was dissolved in 480 parts of methanol/n-butanol mixed solution with a proportion of 2/1 by heating at 65° C., and the resulting solution was cooled. Then, the solution was filtered through a membrane filter FP-022 (pore size: 0.22 μm, manufactured by Sumitomo Electric Industries) to yield a coating liquid for the undercoat layer. This coating liquid was applied to the surface of the electroconductive layer by dipping. The resulting coating film was heated to dry at 100° C. for 10 minutes to yield a 0.5 μm-thick undercoat layer.

Charge Generating Layer

Subsequently, 0.5 part of the hydroxygallium phthalocyanine pigment produced in Synthesis Example 3 and 9.5 parts of N-methylformamide F0059 (produced by Tokyo Chemical Industry) were subjected to milling (first milling operation) with 15 parts of glass beads of 0.9 mm in diameter with a paint shaker (manufactured by Toyo Seiki) at room temperature (23° C.) for 6 hours. For this operation, a standard bottle PS-6 (manufactured by Hakuyo Glass) was used as the container. The liquid subjected to the milling operation was filtered through a filter (N-NO. 125T, pore size: 133 μm, manufactured by NBC Meshtec) to remove the glass beads. The resulting liquid was further subjected to milling (second milling operation) at room temperature (23° C.) for 40 hours by using a ball mill machine. This operation was performed in the standard bottle PS-6 (manufactured by Hakuyo Glass) under the condition where the bottle was rotated at a speed of 120 rpm. In this operation, media, such as glass beads, were not used. After adding 30 parts of N-methylformamide to the resulting liquid, the mixture was filtered, and the filtration product remaining on the filter was sufficiently washed with tetrahydrofuran. Then, the resulting filtration product was vacuum-dried to yield 0.46 part of a hydroxygallium phthalocyanine pigment.

The resulting pigment exhibited peaks at Bragg angles 2θ of 7.4°±0.3°, 9.9°±0.3°, 16.2°±0.3°, 18.6°±0.3°, 25.2°±0.3°, and 28.2°±0.3° in the CuKα X-ray diffraction spectrum thereof. The crystallite correlation lengths $r_1$ and $r_2$, which were estimated from the respective peaks at 7.4°±0.3° and 28.2°±0.3° that were the strongest and the second strongest of the peaks in the range of 5° to 35°, were 31 nm and 19 nm, respectively. Hence, parameter A was 0.60.

Subsequently, 20 parts of the hydroxygallium phthalocyanine pigment subjected to the above-described milling operation, 10 parts of a polyvinyl butyral S-LEC BX-1 (produced by Sekisui Chemical), and 190 parts of cyclohexanone were dispersed in each other with 482 parts of glass beads of 0.9 mm in diameter in a sand mill K-800 (manufactured by Aimex, disk diameter: 70 mm, 5 disks) for 4 hours with cooling water of 18° C. This operation was performed under the condition where the disks were rotated at 1,800 rpm. To the resulting dispersion liquid were added 444 parts of cyclohexanone and 634 parts of ethyl acetate to yield a coating liquid for forming a charge generating layer. This coating liquid was applied to the surface of the undercoat layer by dipping. The resulting coating film was heated to dry at 100° C. for 10 minutes to yield a 230 nm-thick charge generating layer.

The hydroxygallium phthalocyanine pigment had a specific gravity of 1.6, and polyvinyl butyral used as the binder resin had a specific gravity of 1.1. Therefore, the ratio P of the volume of the charge generating material to the total volume of the charge generating layer was calculated to be 0.58.

Charge Transport Layer

A coating liquid for forming a charge transport layer was prepared by dissolving in 630 parts of monochlorobenzene: 70 parts of a triarylamine compound represented by the following formula:

(4)

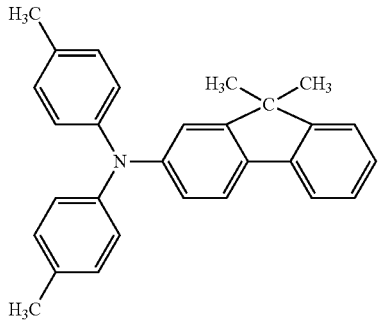

10 parts of a triarylamine compound represented by the following formula:

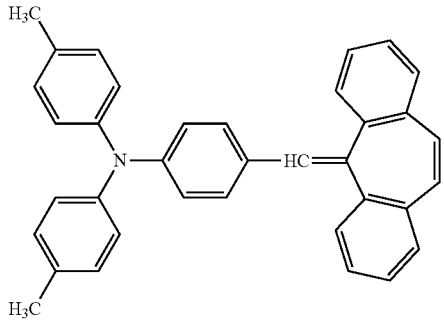

100 parts of polycarbonate IUPILON Z-200 (produced by Mitsubishi Engineering-Plastics).

This coating liquid was applied to the surface of the charge generating layer by dipping. The resulting coating film was heated to dry at 120° C. for 1 hour to yield a 14 μm-thick charge transport layer.

The heating treatments of the electroconductive layer, the undercoat layer, the charge generating layer, and the charge transport layer were performed at the respective temperatures in an oven. The heating treatments of these layers in each of the following Photosensitive Member Production Examples were also performed in the same manner as above. Thus, a cylindrical (drum-shaped) electrophotographic photosensitive member of Photosensitive Member Production Example 1 was completed.

The physical properties of the phthalocyanine pigment, the charge generating layer, and the electrophotographic photosensitive member that were produced as just described were shown in Table 1. In Table 1 and other Tables, "HOGaPc" represents a hydroxygallium phthalocyanine pigment; and "ClGaPc" represents a chlorogallium phthalocyanine pigment.

Photosensitive Member Production Example 2

An electrophotographic photosensitive member of Photosensitive Member Production Example 2 was produced in the same manner as in Photosensitive Member Production Example 1, except that the time for the second milling operation using the ball mill machine was changed from 40 hours to 100 hours. The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 3

An electrophotographic photosensitive member of Photosensitive Member Production Example 3 was produced in the same manner as in Photosensitive Member Production Example 1, except that the time for the second milling operation using the ball mill machine was changed from 40 hours to 300 hours. The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 4

An electrophotographic photosensitive member of Photosensitive Member Production Example 4 was produced in the same manner as in Photosensitive Member Production Example 1, except that the time for the second milling operation using the ball mill machine was changed from 40 hours to 1,000 hours. The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 5

An electrophotographic photosensitive member of Photosensitive Member Production Example 4 was produced in the same manner as in Photosensitive Member Production Example 1, except that the time for the second milling operation using the ball mill machine was changed from 40 hours to 2,000 hours. The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 6

An electrophotographic photosensitive member of Photosensitive Member Production Example 6 was produced in the same manner as in Photosensitive Member Production Example 1, except that the second milling operation in the process for producing the hydroxygallium phthalocyanine pigment was changed as below.

In the first milling operation, 0.5 part of the hydroxygallium phthalocyanine pigment produced in Synthesis Example 3 and 9.5 parts of N-methylformamide F0059 (produced by Tokyo Chemical Industry) were subjected to milling with 15 parts of glass beads of 0.9 mm in diameter with a paint shaker (manufactured by Toyo Seiki) at room temperature (23° C.) for 6 hours. For this operation, a standard bottle PS-6 (manufactured by Hakuyo Glass) was used as the container. The resulting liquid was further subjected to milling (second milling operation) at room temperature (23° C.) for 40 hours by using a ball mill machine. For this operation, the container was set to the ball mill machine as it was without removing the contents therefrom, and the container was rotated at a speed of 120 rpm. Hence, both the first and the second milling operation were performed with the same glass beads. The liquid subjected to this operation was filtered through a filter (N-NO. 125T, pore size: 133 μm, manufactured by NBC Meshtec) to remove the glass beads. After adding 30 parts of N-methylformamide to the resulting liquid, the mixture was filtered, and the filtration product remaining on the filter was sufficiently washed with tetrahydrofuran. Then, the resulting filtration product was vacuum-dried to yield 0.46 part of a hydroxygallium phthalocyanine pigment. The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 7

An electrophotographic photosensitive member of Photosensitive Member Production Example 7 was produced in the same manner as in Photosensitive Member Production Example 6, except that the time for the second milling operation using the ball mill machine was changed from 40 hours to 100 hours. The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 8

An electrophotographic photosensitive member of Photosensitive Member Production Example 8 was produced in the same manner as in Photosensitive Member Production Example 6, except that the time for the second milling operation using the ball mill machine was changed from 40 hours to 300 hours. The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 9

An electrophotographic photosensitive member of Photosensitive Member Production Example 9 was produced in the same manner as in Photosensitive Member Production Example 6, except that the time for the second milling operation using the ball mill machine was changed from 40 hours to 1,000 hours. The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 10

An electrophotographic photosensitive member of Photosensitive Member Production Example 10 was produced in the same manner as in Photosensitive Member Production Example 6, except that the time for the second milling operation using the ball mill machine was changed from 40 hours to 2,000 hours. The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 11

An electrophotographic photosensitive member of Photosensitive Member Production Example 11 was produced in the same manner as in Photosensitive Member Production Example 1, except that the milling operation in the process for producing the hydroxygallium phthalocyanine pigment was changed as below. The physical properties of the resulting phthalocyanine pigment, charge generating layer and electrophotographic photosensitive member were determined in the same manner as in Photosensitive Member Production Example 1, and the results are shown in Table 1.

The hydroxygallium phthalocyanine pigment (1 part) produced in Synthesis Example 3 was dried under reduced pressure to yield a pigment with a water content of 6000 ppm. The resulting pigment was subjected to milling with 9 parts of N-methylformamide F0059 (produced by Tokyo Chemical Industry) and 15 parts of glass beads of 0.9 mm in diameter for 43 hours in a sand mill K-800 (manufactured by Aimex, disk diameter: 70 mm, 5 disks) with cooling water of 18° C. This operation was performed under the condition where the disks were rotated at 200 rpm. In this operation, the water content of the N-methylformamide before being added to the sand mill was 1000 ppm; hence the water content in the system was 1550 ppm. After adding 30 parts of N-methylformamide to the resulting liquid, the mixture was filtered, and the filtration product remaining on the filter was sufficiently washed with tetrahydrofuran. Then, the resulting filtration product was vacuum-dried to yield 0.45 part of a hydroxygallium phthalocyanine pigment.

The resulting pigment exhibited peaks at Bragg angles 2θ of 7.4°±0.3°, 9.9°±0.3°, 16.2°±0.3°, 18.6°±0.3°, 25.2°±0.3°, and 28.2°±0.3° in the CuKα X-ray diffraction spectrum thereof. The crystallite correlation lengths $r_1$ and $r_2$, which were estimated from the respective peaks at 7.4°±0.3° and 28.2°±0.3° that were the strongest and the second strongest of the peaks in the range of 5° to 35°, were 30 nm and 23 nm, respectively. Hence, parameter A was 0.75. An SEM micrograph of the thus produced hydroxygallium phthalocyanine pigment in the charge generating layer is shown in FIG. 1. Also, the physical properties of the phthalocyanine pigment, the charge generating layer, and the electrophotographic photosensitive member that were produced as just described were shown in Table 1.

Photosensitive Member Production Example 12

An electrophotographic photosensitive member of Photosensitive Member Production Example 12 was produced in the same manner as in Photosensitive Member Production Example 11, except that the time for the milling operation using the sand mill was changed from 43 hours to 91 hours. The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 13

An electrophotographic photosensitive member of Photosensitive Member Production Example 13 was produced in the same manner as in Photosensitive Member Production Example 11, except that the time for the milling operation using the sand mill was changed from 43 hours to 100 hours. The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 14

An electrophotographic photosensitive member of Photosensitive Member Production Example 14 was produced in the same manner as in Photosensitive Member Production Example 11, except that the time for the milling operation using the sand mill was changed from 43 hours to 190 hours. The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 15

An electrophotographic photosensitive member of Photosensitive Member Production Example 15 was produced in the same manner as in Photosensitive Member Production Example 11, except that the time for the milling operation using the sand mill was changed from 43 hours to 245 hours. The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 16

An electrophotographic photosensitive member of Photosensitive Member Production Example 16 was produced in the same manner as in Photosensitive Member Production Example 1, except that the milling operation in the process for producing the hydroxygallium phthalocyanine pigment was changed as below. The physical properties of the resulting phthalocyanine pigment, charge generating layer and electrophotographic photosensitive member were determined in the same manner as in Photosensitive Member Production Example 1, and the results are shown in Table 1.

In a sand mill K-800 (manufactured by Aimex, disk diameter: 70 mm, 5 disks) with cooling water of 18° C., 1 part of the hydroxygallium phthalocyanine pigment produced in Synthesis Example 3 and 9 parts of N-methylformamide F0059 (manufactured by Tokyo Chemical Industry) were subjected to milling for 70 hours with 15 parts of glass beads of 0.9 mm in diameter. This operation was performed under the condition where the disks were rotated at 400 rpm. After adding 30 parts of N-methylformamide to the resulting liquid, the mixture was filtered, and the filtration product remaining on the filter was sufficiently washed with tetrahydrofuran. Then, the resulting filtration product was vacuum-dried to yield 0.45 part of a hydroxygallium phthalocyanine pigment.

The resulting pigment exhibited peaks at Bragg angles 2θ of 7.4°±0.3°, 9.9°±0.3°, 16.2°±0.3°, 18.6°±0.3°, 25.2°±0.3°, and 28.2°±0.3° in the CuKα X-ray diffraction spectrum thereof. The crystallite correlation lengths $r_1$ and $r_2$, which were estimated from the respective peaks at 7.4°±0.3° and 28.2°±0.3° that were the strongest and the second strongest of the peaks in the range of 5° to 35°, were 33 nm and 17 nm, respectively. Hence, parameter A was 0.50. The physical properties of the phthalocyanine pigment, the charge generating layer, and the electrophotographic photosensitive member that were produced as just described were shown in Table 1.

Photosensitive Member Production Example 17

An electrophotographic photosensitive member of Photosensitive Member Production Example 16 was produced in the same manner as in Photosensitive Member Production Example 15, except that the time for the milling operation using the sand mill was changed from 70 hours to 100 hours. The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 18

An electrophotographic photosensitive member of Photosensitive Member Production Example 18 was produced in the same manner as in Photosensitive Member Production Example 1, except that the milling operation in the process for producing the hydroxygallium phthalocyanine pigment was changed as below. The physical properties of the resulting phthalocyanine pigment, charge generating layer and electrophotographic photosensitive member were determined in the same manner as in Photosensitive Member Production Example 1, and the results are shown in Table 1.

In a vacuum heating dryer with a vacuum adjusted to 10 Pa or less, 0.5 part of the hydroxygallium phthalocyanine pigment produced in Synthesis Example 3 was vacuum dried at 60° C. for 12 hours. The water content of this pigment was 2000 ppm. The pigment was treated as below in an atmospheric pressure glove box. The pigment was subjected to milling with 9.5 parts of N-methylformamide F0059 (produced by Tokyo Chemical Industry) and 15 parts of glass beads of 0.9 mm in diameter for 40 hours in a ball mill machine at room temperature (23° C.). In this operation, the water content of the N-methylformamide before being added to the ball mill was 80 ppm; hence the water content in the system was 170 ppm. This operation was performed under the condition where the container was rotated at 120 rpm. After adding 30 parts of N-methylformamide to the resulting liquid, the mixture was filtered, and the filtration product remaining on the filter was sufficiently washed with tetrahydrofuran. Then, the resulting filtration product was vacuum-dried to yield 0.46 part of a hydroxygallium phthalocyanine pigment. The resulting pigment exhibited peaks at Bragg angles 2θ of 7.4°±0.30, 9.9°±0.3°, 16.2°±0.3°, 18.6°±0.3°, 25.2°±0.3°, and 28.2°±0.3° in the CuKα X-ray diffraction spectrum thereof. The crystallite correlation lengths $r_1$ and $r_2$, which were estimated from the respective peaks at 7.4°±0.3° and 28.2°±0.3° that were the strongest and the second strongest of the peaks in the range of 5° to 35°, were 36 nm and 19 nm, respectively. Hence, parameter A was 0.51. The physical properties of the phthalocyanine pigment, the charge generating layer, and the electrophotographic photosensitive member that were produced as just described were shown in Table 1.

Photosensitive Member Production Example 19

An electrophotographic photosensitive member of Photosensitive Member Production Example 19 was produced in the same manner as in Photosensitive Member Production Example 18, except that the time for the vacuum drying with heating was changed to 6 hours. In this operation, the water contents of the hydroxygallium phthalocyanine pigment and the N-methylformamide, before being added to the mill were 3500 ppm and 80 ppm, respectively; hence the water content in the system was 243 ppm.

Photosensitive Member Production Example 20

An electrophotographic photosensitive member of Photosensitive Member Production Example 20 was produced in the same manner as in Photosensitive Member Production Example 18, except that the time for the vacuum drying with heating was changed to 3 hours. In this operation, the water contents of the hydroxygallium phthalocyanine pigment and the N-methylformamide, before being added to the mill were 7500 ppm and 80 ppm, respectively; hence the water content in the system was 433 ppm.

Photosensitive Member Production Example 21

An electrophotographic photosensitive member of Photosensitive Member Production Example 21 was produced in the same manner as in Photosensitive Member Production Example 18, except that the vacuum drying with heating was not performed and that the water content of the N-methylformamide was adjusted to 1000 ppm. In this operation, the water content of the hydroxygallium phthalocyanine pigment before being added to the mill was 11000 ppm; hence the water content in the system was 1477 ppm.

Photosensitive Member Production Example 22

An electrophotographic photosensitive member of Photosensitive Member Production Example 22 was produced in the same manner as in Photosensitive Member Production Example 18, except that the vacuum drying with heating was not performed and that the water content of the N-methylformamide was adjusted to 2000 ppm. In this operation, the water content of the hydroxygallium phthalocyanine pigment before being added to the mill was 11000 ppm; hence the water content in the system was 2430 ppm.

Photosensitive Member Production Examples 23 to 27

Electrophotographic photosensitive members of Photosensitive Member Production Examples 23 to 27 were produced in the same manner as in Photosensitive Member Production Example 3, except that their charge transport layers were formed to respective thicknesses of 11 μm, 17 μm, 20 μm, 23 μm, and 27 μm.

Photosensitive Member Production Examples 28 to 30

Electrophotographic photosensitive members of Photosensitive Member Production Examples 28 to 30 were produced in the same manner as in Photosensitive Member Production Example 3, except that their charge generating layers were formed to respective thicknesses of 210 nm, 250 nm, and 350 nm.

Photosensitive Member Production Examples 31 to 33

Electrophotographic photosensitive members of Photosensitive Member Production Examples 31 to 33 were produced in the same manner as in Photosensitive Member Production Example 16, except that their charge generating layers were formed to respective thicknesses of 210 nm, 250 nm, and 350 nm.

Photosensitive Member Production Example 34

An electrophotographic photosensitive member of Photosensitive Member Production Example 34 was produced in the same manner as in Photosensitive Member Production Example 3, except that the amounts of the hydroxygallium phthalocyanine pigment after milling operation and the polyvinyl butyral resin were changed to 17.5 parts and 10 parts, respectively.

Photosensitive Member Production Example 35

An electrophotographic photosensitive member of Photosensitive Member Production Example 35 was produced in the same manner as in Photosensitive Member Production Example 3, except that the amounts of the hydroxygallium phthalocyanine pigment after milling operation and the polyvinyl butyral resin were changed to 30 parts and 10 parts, respectively.

Photosensitive Member Production Example 36

An electrophotographic photosensitive member of Photosensitive Member Production Example 36 was produced in the same manner as in Photosensitive Member Production Example 3, except that the amounts of the hydroxygallium phthalocyanine pigment after milling operation and the polyvinyl butyral resin were changed to 40 parts and 10 parts, respectively.

Photosensitive Member Production Example 37

An electrophotographic photosensitive member of Photosensitive Member Production Example 37 was produced in the same manner as in Photosensitive Member Production Example 16, except that the amounts of the hydroxygallium phthalocyanine pigment after milling operation and the polyvinyl butyral resin were changed to 17.5 parts and 10 parts, respectively.

Photosensitive Member Production Example 38

An electrophotographic photosensitive member of Photosensitive Member Production Example 38 was produced in the same manner as in Photosensitive Member Production Example 16, except that the amounts of the hydroxygallium phthalocyanine pigment after milling operation and the polyvinyl butyral resin were changed to 30 parts and 10 parts, respectively.

Photosensitive Member Production Example 39

An electrophotographic photosensitive member of Photosensitive Member Production Example 39 was produced in the same manner as in Photosensitive Member Production Example 16, except that the amounts of the hydroxygallium phthalocyanine pigment after milling operation and the polyvinyl butyral resin were changed to 40 parts and 10 parts, respectively.

Photosensitive Member Production Example 40

An electrophotographic photosensitive member of Photosensitive Member Production Example 40 was produced in the same manner as in Photosensitive Member Production Example 20, except that the amounts of the hydroxygallium phthalocyanine pigment after milling operation and the polyvinyl butyral resin were changed to 17.5 parts and 10 parts, respectively.

Photosensitive Member Production Example 41

An electrophotographic photosensitive member of Photosensitive Member Production Example 41 was produced in the same manner as in Photosensitive Member Production Example 20, except that the amounts of the hydroxygallium phthalocyanine pigment after milling operation and the polyvinyl butyral resin were changed to 30 parts and 10 parts, respectively.

Photosensitive Member Production Example 42

An electrophotographic photosensitive member of Photosensitive Member Production Example 42 was produced in the same manner as in Photosensitive Member Production Example 20, except that the amounts of the hydroxygallium phthalocyanine pigment after milling operation and the polyvinyl butyral resin were changed to 40 parts and 10 parts, respectively.

Photosensitive Member Production Example 43

An electrophotographic photosensitive member of Photosensitive Member Production Example 43 was produced in the same manner as in Photosensitive Member Production Example 1, except that the step of forming the charge generating layer was changed as below.

In the first milling operation, 0.5 part of the chlorogallium phthalocyanine pigment produced in Synthesis Example 4 and 10 parts of N,N-dimethylformamide D0722 (produced by Tokyo Chemical Industry) were subjected to milling with 15 parts of glass beads of 0.9 mm in diameter with a paint shaker (manufactured by Toyo Seiki) at room temperature (23° C.) for 1 hour. For this operation, a standard bottle PS-6 (manufactured by Hakuyo Glass) was used as the container. The liquid subjected to the milling operation was filtered through a filter (N-NO. 125T, pore size: 133 μm, manufactured by NBC Meshtec) to remove the glass beads. The resulting liquid was further subjected to milling (second milling operation) at room temperature (23° C.) for 20 hours by using a ball mill machine. This operation was performed in the standard bottle PS-6 (manufactured by Hakuyo Glass) under the condition where the bottle was rotated at a speed of 120 rpm. In this operation, media, such as glass beads, were not used. After adding 30 parts of N,N-dimethylformamide to the resulting liquid, the mixture was filtered, and the filtration product remaining on the filter was sufficiently washed with tetrahydrofuran. Then, the washed filtration product was vacuum-dried to yield 0.46 part of a chlorogallium phthalocyanine pigment.

The resulting pigment was exhibited peaks at Bragg angles 2θ±0.2° of 7.4°, 16.6°, 25.5°, and 28.4° in the CuKα X-ray diffraction spectrum thereof. The crystallite correlation lengths $r_1$ and $r_2$, which were estimated from the respective peaks at 7.4° and 28.4° that were the strongest and the second strongest of the peaks in the range of 5° to 35°, were 36 nm and 29 nm, respectively. Hence, parameter A was 0.86.

Subsequently, 30 parts of the chlorogallium phthalocyanine pigment subjected to the above-described milling operation, 10 parts of a polyvinyl butyral S-LEC BX-1 (produced by Sekisui Chemical), and 253 parts of cyclohexanone were dispersed in each other with 643 parts of glass beads of 0.9 mm in diameter in a sand mill K-800 (manufactured by Aimex, disk diameter: 70 mm, 5 disks) for 4 hours with cooling water of 18° C. This operation was performed under the condition where the disks were rotated at 1,800 rpm. To the resulting dispersion liquid were added 592 parts of cyclohexanone and 845 parts of ethyl acetate to yield a coating liquid for forming a charge generating layer. This coating liquid was applied to the surface of the undercoat layer by dipping. The resulting coating film was heated to dry at 100° C. for 10 minutes to yield a 230 nm-thick charge generating layer.

The chlorogallium phthalocyanine pigment had a specific gravity of 1.6, and polyvinyl butyral used as the binder resin had a specific gravity of 1.1. Therefore, the ratio P of the volume of the charge generating material to the total volume of the charge generating layer was calculated to be 0.67. The physical properties of the phthalocyanine pigment, the charge generating layer, and the electrophotographic photosensitive member that were produced as just described were shown in Table 1.

Photosensitive Member Production Example 44

An electrophotographic photosensitive member of Photosensitive Member Production Example 44 was produced in the same manner as in Photosensitive Member Production Example 43, except that the time for the second milling operation was changed to 40 hours.

Photosensitive Member Production Example 45

An electrophotographic photosensitive member of Photosensitive Member Production Example 45 was produced in the same manner as in Photosensitive Member Production Example 43, except that the time for the second milling operation was changed to 100 hours.

Photosensitive Member Production Example 46

An electrophotographic photosensitive member of Photosensitive Member Production Example 46 was produced in the same manner as in Photosensitive Member Production Example 43, except that the time for the second milling operation was changed to 300 hours.

Photosensitive Member Production Example 47

An electrophotographic photosensitive member of Photosensitive Member Production Example 47 was produced in the same manner as in Photosensitive Member Production Example 45, except that the amounts of the chlorogallium phthalocyanine pigment after milling operation and the polyvinyl butyral resin were changed to 20 parts and 10 parts, respectively.

Photosensitive Member Production Example 48

An electrophotographic photosensitive member of Photosensitive Member Production Example 48 was produced in the same manner as in Photosensitive Member Production Example 46, except that the amounts of the chlorogallium phthalocyanine pigment after milling operation and the polyvinyl butyral resin were changed to 20 parts and 10 parts, respectively.

Photosensitive Member Production Example 49

An electrophotographic photosensitive member of Photosensitive Member Production Example 49 was produced in the same manner as in Photosensitive Member Production Example 1, except that the process for producing the hydroxygallium phthalocyanine pigment was changed as below.

Using a ball mill machine, 0.5 part of the hydroxygallium phthalocyanine pigment produced in Synthesis Example 3 and 9.5 parts of acetone were subjected to milling at room temperature (23° C.) for 10 hours. This operation was performed in the standard bottle PS-6 (manufactured by Hakuyo Glass) under the condition where the bottle was rotated at a speed of 120 rpm. In this operation, media, such as glass beads, were not used. After adding 30 parts of acetone to the resulting liquid, the mixture was filtered, and the filtration product remaining on the filter was sufficiently washed with tetrahydrofuran. Then, the resulting filtration product was vacuum-dried to yield 0.43 part of a hydroxygallium phthalocyanine pigment.

The resulting pigment before centrifugation was exhibited peaks at Bragg angles 2θ of 7.5°±0.2°, 9.9°±0.2°, 16.2°±0.2°, 18.6°±0.2°, 25.2°±0.2°, and 28.2°±0.2° in the CuKα X-ray diffraction spectrum thereof. The crystallite correlation lengths $r_1$ and $r_2$, which were estimated from the respective peaks at 7.5°±0.2° and 28.2°±0.2° that were the strongest and the second strongest of the peaks in the range of 5° to 35°, were 25 nm and 30 nm, respectively. Hence, parameter A was 1.2.

The physical properties of the phthalocyanine pigment, the charge generating layer, and the electrophotographic photosensitive member that were produced as just described were determined in the same manner as in Photosensitive Member Production Example 1, and the results are shown in Table 2.

Photosensitive Member Production Example 50

An electrophotographic photosensitive member of Photosensitive Member Production Example 50 was produced in the same manner as in Photosensitive Member Production Example 49, except that the time for the milling operation was changed to 20 hours.

Photosensitive Member Production Example 51

An electrophotographic photosensitive member of Photosensitive Member Production Example 51 was produced in the same manner as in Photosensitive Member Production Example 49, except that the time for the milling operation was changed to 30 hours.

Photosensitive Member Production Example 52

An electrophotographic photosensitive member of Photosensitive Member Production Example 52 was produced in the same manner as in Photosensitive Member Production Example 49, except that the time for the milling operation was changed to 40 hours.

Photosensitive Member Production Example 53

An electrophotographic photosensitive member of Photosensitive Member Production Example 53 was produced in the same manner as in Photosensitive Member Production Example 49, except that the time for the milling operation was changed to 100 hours.

Photosensitive Member Production Example 54

An electrophotographic photosensitive member of Photosensitive Member Production Example 54 was produced in the same manner as in Photosensitive Member Production Example 49, except that the time for the milling operation was changed to 140 hours.

Photosensitive Member Production Example 55

An electrophotographic photosensitive member of Photosensitive Member Production Example 55 was produced in the same manner as in Photosensitive Member Production Example 49, except that the time for the milling operation was changed to 300 hours.

Photosensitive Member Production Example 56

An electrophotographic photosensitive member of Photosensitive Member Production Example 56 was produced in the same manner as in Photosensitive Member Production Example 49, except that the time for the milling operation was changed to 500 hours.

Photosensitive Member Production Example 57

An electrophotographic photosensitive member of Photosensitive Member Production Example 57 was produced in the same manner as in Photosensitive Member Production Example 49, except that the time for the milling operation was changed to 1000 hours.

Photosensitive Member Production Example 58

An electrophotographic photosensitive member of Photosensitive Member Production Example 58 was produced in the same manner as in Photosensitive Member Production Example 49, except that the time for the milling operation was changed to 2000 hours.

Photosensitive Member Production Example 59

An electrophotographic photosensitive member of Photosensitive Member Production Example 60 was produced in the same manner as in Photosensitive Member Production Example 1, except that the process for producing the hydroxygallium phthalocyanine pigment was changed as below.

In the first milling operation, 0.5 part of the hydroxygallium phthalocyanine pigment produced in Synthesis Example 3 and 9.5 parts of N-methylformamide F0059 (produced by Tokyo Chemical Industry) were subjected to milling with 15 parts of glass beads of 0.9 mm in diameter with a paint shaker (manufactured by Toyo Seiki) at room temperature (23° C.) for 20 hours. For this operation, a standard bottle PS-6 (manufactured by Hakuyo Glass) was used as the container. The liquid subjected to this operation was filtered through a filter (N-NO. 125T, pore size: 133 μm, manufactured by NBC Meshtec) to remove the glass beads. After adding 30 parts of N-methylformamide to the resulting liquid, the mixture was filtered, and the filtration product remaining on the filter was sufficiently washed with tetrahydrofuran. Then, the resulting filtration product was vacuum-dried to yield 0.46 part of a hydroxygallium phthalocyanine pigment.

Photosensitive Member Production Example 60

An electrophotographic photosensitive member of Photosensitive Member Production Example 60 was produced in the same manner as in Photosensitive Member Production Example 59, except that the time for the milling operation was changed to 30 hours.

Photosensitive Member Production Example 61

An electrophotographic photosensitive member of Photosensitive Member Production Example 61 was produced in the same manner as in Photosensitive Member Production Example 1, except that the process for producing the hydroxygallium phthalocyanine pigment was changed as below.

Using a ball mill machine, 0.5 part of the hydroxygallium phthalocyanine pigment produced in Synthesis Example 3 and 9.5 parts of N-methylformamide F0059 (manufactured by Tokyo Chemical Industry) were subjected to milling with 15 parts of glass beads of 0.9 mm in diameter at room temperature (23° C.) for 5 hours. This operation was performed in the standard bottle PS-6 (manufactured by Hakuyo Glass) under the condition where the bottle was rotated at a speed of 60 rpm. The liquid subjected to this operation was filtered through a filter (N-NO. 125T, pore size: 133 μm, manufactured by NBC Meshtec) to remove the glass beads. After adding 30 parts of N-methylformamide to the resulting liquid, the mixture was filtered, and the filtration product remaining on the filter was sufficiently washed with tetrahydrofuran. Then, the resulting filtration product was vacuum-dried to yield 0.47 part of a hydroxygallium phthalocyanine pigment.

Photosensitive Member Production Example 62

An electrophotographic photosensitive member of Photosensitive Member Production Example 62 was produced in the same manner as in Photosensitive Member Production Example 61, except that the time for the milling operation was changed to 10 hours.

Photosensitive Member Production Example 63

An electrophotographic photosensitive member of Photosensitive Member Production Example 63 was produced in the same manner as in Photosensitive Member Production Example 61, except that the time for the milling operation was changed to 30 hours.

Photosensitive Member Production Example 64

An electrophotographic photosensitive member of Photosensitive Member Production Example 64 was produced in the same manner as in Photosensitive Member Production Example 61, except that the time for the milling operation was changed to 100 hours.

Photosensitive Member Production Examples 65 to 69

Electrophotographic photosensitive members of Photosensitive Member Production Examples 65 to 69 were produced in the same manner as in Photosensitive Member Production Example 55, except that their charge transport layers were formed to respective thicknesses of 11 μm, 17 μm, 20 μm, 23 μm, and 27 μm.

Photosensitive Member Production Examples 70 to 72

Electrophotographic photosensitive members of Photosensitive Member Production Examples 70 to 72 were produced in the same manner as in Photosensitive Member Production Example 63, except that their charge generating layers were formed to respective thicknesses of 210 nm, 250 nm, and 350 nm.

Photosensitive Member Production Examples 73 to 75

Electrophotographic photosensitive members of Photosensitive Member Production Examples 73 to 75 were produced in the same manner as in Photosensitive Member Production Example 57, except that their charge generating layers were formed to respective thicknesses of 210 nm, 250 nm, and 350 nm.

Photosensitive Member Production Example 76

An electrophotographic photosensitive member of Photosensitive Member Production Example 76 was produced in the same manner as in Photosensitive Member Production Example 57 except that the amounts of the hydroxygallium phthalocyanine pigment after milling operation and the polyvinyl butyral resin were changed to 17.5 parts and 10 parts, respectively.

Photosensitive Member Production Example 77

An electrophotographic photosensitive member of Photosensitive Member Production Example 77 was produced in the same manner as in Photosensitive Member Production Example 57 except that the amounts of the hydroxygallium phthalocyanine pigment after milling operation and the polyvinyl butyral resin were changed to 30 parts and 10 parts, respectively.

Photosensitive Member Production Example 78

An electrophotographic photosensitive member of Photosensitive Member Production Example 78 was produced in the same manner as in Photosensitive Member Production Example 57 except that the amounts of the hydroxygallium phthalocyanine pigment after milling operation and the polyvinyl butyral resin were changed to 40 parts and 10 parts, respectively.

Photosensitive Member Production Example 79

An electrophotographic photosensitive member of Photosensitive Member Production Example 79 was produced in the same manner as in Photosensitive Member Production Example 45, except that the process for producing the chlorogallium phthalocyanine pigment was changed as below.

In the first milling operation, 0.5 part of the chlorogallium phthalocyanine pigment produced in Synthesis Example 6 was subjected to milling with 10 parts of alumina beads of 5.0 mm in diameter at room temperature (23° C.) for 180 hours by using a vibration mill MB-1 (manufactured by Chuo Kakohki). For this operation, an alumina pot was used as the container. Thus, 0.45 part of a chlorogallium phthalocyanine pigment was produced. Subsequently, 0.5 part of the resulting chlorogallium phthalocyanine pigment and 10 parts of dimethyl sulfoxide D0798 (produced by Tokyo Chemical Industry) were subjected to milling (second milling operation) with 29 parts of glass beads of 1.0 mm in diameter at 25° C. for 72 hours by using a ball mill machine. This operation was performed in the standard bottle PS-6 (manufactured by Hakuyo Glass) under the condition where the bottle was rotated at a speed of 60 rpm. The liquid subjected to this operation was filtered through a filter (N-NO. 125T, pore size: 133 μm, manufactured by NBC Meshtec) to remove the glass beads. After adding 30 parts of dimethyl sulfoxide to the resulting liquid, the mixture was filtered, and the filtration product remaining on the filter was sufficiently washed with acetone. Then, the washed filtration product was dried by heating at 80° C. for 24 hours under reduced pressure (vacuum) to yield 0.46 part of a chlorogallium phthalocyanine pigment.

Photosensitive Member Production Example 80

An electrophotographic photosensitive member of Photosensitive Member Production Example 80 was produced in the same manner as in Photosensitive Member Production Example 79, except that second milling operation using the ball mill machine, which was performed with 29 parts of glass beads of 1.0 mm in diameter for 72 hours in Photosensitive Member Production Example 79, was performed with 29 parts of glass beads of 1.5 mm in diameter for 96 hours.

Photosensitive Member Production Example 81

An electrophotographic photosensitive member of Photosensitive Member Production Example 81 was produced in the same manner as in Photosensitive Member Production Example 1, except that the process for producing the hydroxygallium phthalocyanine pigment was changed as below.

Using a ball mill machine, 0.5 part of the hydroxygallium phthalocyanine pigment produced in Synthesis Example 7 and 7.5 parts of N,N-dimethylformamide D0722 (manufactured by Tokyo Chemical Industry) were subjected to milling with 29 parts of glass beads of 0.9 mm in diameter at a temperature of 25° C. for 48 hours. This operation was performed in the standard bottle PS-6 (manufactured by Hakuyo Glass) under the condition where the bottle was rotated at a speed of 60 rpm. The liquid subjected to this operation was filtered through a filter (N-NO. 125T, pore size: 133 μm, manufactured by NBC Meshtec) to remove the glass beads. After adding 30 parts of N,N-dimethylformamide to the resulting liquid, the mixture was filtered, and the filtration product remaining on the filter was sufficiently washed with acetone. Then, the resulting filtration product was vacuum-dried to yield 0.46 part of a hydroxygallium phthalocyanine pigment.

Photosensitive Member Production Example 82

An electrophotographic photosensitive member of Photosensitive Member Production Example 82 was produced in the same manner as in Photosensitive Member Production Example 81, except that the time for the milling operation using the ball mill machine was changed from 48 hours to 96 hours.

Photosensitive Member Production Example 83

An electrophotographic photosensitive member of Photosensitive Member Production Example 83 was produced in the same manner as in Photosensitive Member Production Example 81, except that the time for the milling operation using the ball mill machine was changed from 48 hours to 192 hours.

Photosensitive Member Production Example 84

An electrophotographic photosensitive member of Photosensitive Member Production Example 84 was produced in the same manner as in Photosensitive Member Production Example 1, except that the process for producing the hydroxygallium phthalocyanine pigment was changed as below.

In the first milling operation, 0.5 part of the hydroxygallium phthalocyanine pigment produced in Synthesis Example 7 and 8 parts of N,N-dimethylformamide D0722 (manufactured by Tokyo Chemical Industry) were subjected to milling at 30° C. for 24 hours by using a magnetic stirrer. This operation was performed in the standard bottle PS-6 (manufactured by Hakuyo Glass) under the condition where the stirring bar was rotated at a speed of 1,500 rpm. After adding 30 parts of N,N-dimethylformamide to the resulting liquid, the mixture was filtered, and the filtration product remaining on the filter was sufficiently washed with ion exchanged water. Then, the resulting filtration product was vacuum-dried to yield 0.45 part of a hydroxygallium phthalocyanine pigment. Subsequently, 0.5 part of the resulting hydroxygallium phthalocyanine pigment was subjected to milling (second milling operation) with 5 parts of zirconia beads of 5.0 mm in diameter at room temperature (23° C.) for 5 minutes by using a small vibration mill MB-0 (manufactured by Chuo Kakohki). For this operation, an alumina pot was used as the container. Thus, 0.48 part of a hydroxygallium phthalocyanine pigment was produced.

Photosensitive Member Production Example 85

An electrophotographic photosensitive member of Photosensitive Member Production Example 85 was produced in the same manner as in Photosensitive Member Production Example 84, except that the time for the second milling operation using the small vibration mill was changed from 5 minutes to 20 minutes.

Photosensitive Member Production Example 86

An electrophotographic photosensitive member of Photosensitive Member Production Example 86 was produced in the same manner as in Photosensitive Member Production Example 84, except that the time for the second milling operation using the small vibration mill was changed from 5 minutes to 40 minutes.

Photosensitive Member Production Example 87

An electrophotographic photosensitive member of Photosensitive Member Production Example 87 was produced in the same manner as in Photosensitive Member Production Example 1, except that the process for producing the hydroxygallium phthalocyanine pigment was changed as below.

Using a ball mill machine, 0.5 part of the hydroxygallium phthalocyanine pigment produced in Synthesis Example 8 and 7.5 parts of N,N-dimethylformamide D0722 (manufactured by Tokyo Chemical Industry) were subjected to milling with 29 parts of glass beads of 0.9 mm in diameter at a temperature of 25° C. for 24 hours. This operation was performed in the standard bottle PS-6 (manufactured by Hakuyo Glass) under the condition where the bottle was rotated at a speed of 60 rpm. The liquid subjected to this operation was filtered through a filter (N-NO. 125T, pore size: 133 μm, manufactured by NBC Meshtec) to remove the glass beads. After adding 30 parts of N,N-dimethylformamide to the resulting liquid, the mixture was filtered, and the filtration product remaining on the filter was sufficiently washed with n-butyl acetate. Then, the resulting filtration product was vacuum-dried to yield 0.45 part of a hydroxygallium phthalocyanine pigment.

Photosensitive Member Production Example 88

An electrophotographic photosensitive member of Photosensitive Member Production Example 88 was produced in the same manner as in Photosensitive Member Production Example 87, except that 0.5 part of the hydroxygallium phthalocyanine pigment produced in Synthesis Example 8 was replaced with 0.5 part of the hydroxygallium phthalocyanine pigment produced in Synthesis Example 9.

TABLE 1

Production Conditions and Physical Properties of Photosensitive Member

| Photosensitive member | | Photosensitive member physical properties | | | | | | | | | |
|---|---|---|---|---|---|---|---|---|---|---|---|
| | | Volume ratio | Charge generating layer thickness | Charge transport layer thickness | First peak | | | Second peak | | | |
| Production Example | Pigment | P | [μm] | [μm] | $2\theta_1$ | $\beta_1$ | $r_1$ | $2\theta_2$ | $\beta_2$ | $r_2$ | A |
| Production Example 1 | HOGaPc | 0.58 | 0.23 | 14 | 7.42 | 0.29 | 31 | 28.20 | 0.49 | 19 | 0.60 |
| Production Example 2 | HOGaPc | 0.58 | 0.23 | 14 | 7.42 | 0.29 | 31 | 28.23 | 0.41 | 22 | 0.72 |
| Production Example 3 | HOGaPc | 0.58 | 0.23 | 14 | 7.43 | 0.26 | 34 | 28.28 | 0.45 | 20 | 0.59 |
| Production Example 4 | HOGaPc | 0.58 | 0.23 | 14 | 7.43 | 0.26 | 34 | 28.31 | 0.45 | 20 | 0.60 |
| Production Example 5 | HOGaPc | 0.58 | 0.23 | 14 | 7.43 | 0.25 | 36 | 28.31 | 0.42 | 22 | 0.60 |
| Production Example 6 | HOGaPc | 0.58 | 0.23 | 14 | 7.40 | 0.33 | 27 | 28.18 | 0.45 | 20 | 0.74 |
| Production Example 7 | HOGaPc | 0.58 | 0.23 | 14 | 7.42 | 0.30 | 29 | 28.20 | 0.46 | 20 | 0.69 |
| Production Example 8 | HOGaPc | 0.58 | 0.23 | 14 | 7.44 | 0.30 | 29 | 28.25 | 0.52 | 18 | 0.61 |
| Production Example 9 | HOGaPc | 0.58 | 0.23 | 14 | 7.43 | 0.29 | 31 | 28.29 | 0.50 | 18 | 0.59 |
| Production Example 10 | HOGaPc | 0.58 | 0.23 | 14 | 7.44 | 0.26 | 34 | 28.25 | 0.44 | 21 | 0.61 |
| Production Example 11 | HOGaPc | 0.58 | 0.23 | 14 | 7.42 | 0.29 | 30 | 28.21 | 0.40 | 23 | 0.75 |
| Production Example 12 | HOGaPc | 0.58 | 0.23 | 14 | 7.42 | 0.30 | 30 | 28.23 | 0.50 | 18 | 0.61 |
| Production Example 13 | HOGaPc | 0.58 | 0.23 | 14 | 7.42 | 0.26 | 34 | 28.22 | 0.43 | 21 | 0.63 |
| Production Example 14 | HOGaPc | 0.58 | 0.23 | 14 | 7.42 | 0.29 | 31 | 28.21 | 0.58 | 16 | 0.51 |
| Production Example 15 | HOGaPc | 0.58 | 0.23 | 14 | 7.43 | 0.28 | 32 | 28.22 | 0.53 | 17 | 0.55 |
| Production Example 16 | HOGaPc | 0.58 | 0.23 | 14 | 7.43 | 0.27 | 33 | 28.31 | 0.54 | 17 | 0.50 |
| Production Example 17 | HOGaPc | 0.58 | 0.23 | 14 | 7.43 | 0.27 | 33 | 28.32 | 0.49 | 18 | 0.56 |
| Production Example 18 | HOGaPc | 0.58 | 0.23 | 14 | 7.44 | 0.24 | 36 | 28.28 | 0.49 | 19 | 0.52 |
| Production Example 19 | HOGaPc | 0.58 | 0.23 | 14 | 7.45 | 0.24 | 36 | 28.30 | 0.49 | 19 | 0.52 |
| Production Example 20 | HOGaPc | 0.58 | 0.23 | 14 | 7.44 | 0.25 | 36 | 28.31 | 0.44 | 21 | 0.58 |
| Production Example 21 | HOGaPc | 0.58 | 0.23 | 14 | 7.44 | 0.25 | 36 | 28.33 | 0.40 | 23 | 0.64 |
| Production Example 22 | HOGaPc | 0.58 | 0.23 | 14 | 7.42 | 0.24 | 36 | 28.23 | 0.34 | 27 | 0.73 |
| Production Example 23 | HOGaPc | 0.58 | 0.23 | 11 | 7.44 | 0.30 | 29 | 28.25 | 0.52 | 18 | 0.61 |
| Production Example 24 | HOGaPc | 0.58 | 0.23 | 17 | 7.44 | 0.30 | 29 | 28.25 | 0.52 | 18 | 0.61 |
| Production Example 25 | HOGaPc | 0.58 | 0.23 | 20 | 7.44 | 0.30 | 29 | 28.25 | 0.52 | 18 | 0.61 |
| Production Example 26 | HOGaPc | 0.58 | 0.23 | 23 | 7.44 | 0.30 | 29 | 28.25 | 0.52 | 18 | 0.61 |
| Production Example 27 | HOGaPc | 0.58 | 0.23 | 27 | 7.44 | 0.30 | 29 | 28.25 | 0.52 | 18 | 0.61 |
| Production Example 28 | HOGaPc | 0.58 | 0.21 | 14 | 7.44 | 0.30 | 29 | 28.25 | 0.52 | 18 | 0.61 |
| Production Example 29 | HOGaPc | 0.58 | 0.25 | 14 | 7.44 | 0.30 | 29 | 28.25 | 0.52 | 18 | 0.61 |
| Production Example 30 | HOGaPc | 0.58 | 0.35 | 14 | 7.44 | 0.30 | 29 | 28.25 | 0.52 | 18 | 0.61 |
| Production Example 31 | HOGaPc | 0.58 | 0.21 | 14 | 7.43 | 0.27 | 33 | 28.31 | 0.54 | 17 | 0.50 |
| Production Example 32 | HOGaPc | 0.58 | 0.25 | 14 | 7.43 | 0.27 | 33 | 28.31 | 0.54 | 17 | 0.50 |
| Production Example 33 | HOGaPc | 0.58 | 0.35 | 14 | 7.43 | 0.27 | 33 | 28.31 | 0.54 | 17 | 0.50 |
| Production Example 34 | HOGaPc | 0.55 | 0.23 | 14 | 7.44 | 0.30 | 29 | 28.25 | 0.52 | 18 | 0.61 |
| Production Example 35 | HOGaPc | 0.67 | 0.23 | 14 | 7.44 | 0.30 | 29 | 28.25 | 0.52 | 18 | 0.61 |
| Production Example 36 | HOGaPc | 0.73 | 0.23 | 14 | 7.44 | 0.30 | 29 | 28.25 | 0.52 | 18 | 0.61 |

TABLE 1-continued

Production Conditions and Physical Properties of Photosensitive Member

| Photosensitive member | | Photosensitive member physical properties | | | | | | | | | |
|---|---|---|---|---|---|---|---|---|---|---|---|
| | | Volume ratio | Charge generating layer thickness | Charge transport layer thickness | First peak | | | Second peak | | | |
| Production Example | Pigment | P | [μm] | [μm] | $2\theta_1$ | $\beta_1$ | $r_1$ | $2\theta_2$ | $\beta_2$ | $r_2$ | A |
| Production Example 37 | HOGaPc | 0.55 | 0.23 | 14 | 7.43 | 0.27 | 33 | 28.31 | 0.54 | 17 | 0.50 |
| Production Example 38 | HOGaPc | 0.67 | 0.23 | 14 | 7.43 | 0.27 | 33 | 28.31 | 0.54 | 17 | 0.50 |
| Production Example 39 | HOGaPc | 0.73 | 0.23 | 14 | 7.43 | 0.27 | 33 | 28.31 | 0.54 | 17 | 0.50 |
| Production Example 40 | HOGaPc | 0.55 | 0.23 | 14 | 7.45 | 0.24 | 36 | 28.30 | 0.49 | 19 | 0.52 |
| Production Example 41 | HOGaPc | 0.67 | 0.23 | 14 | 7.45 | 0.24 | 36 | 28.30 | 0.49 | 19 | 0.52 |
| Production Example 42 | HOGaPc | 0.67 | 0.23 | 14 | 7.45 | 0.24 | 36 | 28.30 | 0.49 | 19 | 0.52 |
| Production Example 43 | ClGaPc | 0.67 | 0.23 | 14 | 7.36 | 0.24 | 36 | 28.35 | 0.29 | 31 | 0.86 |
| Production Example 44 | ClGaPc | 0.67 | 0.23 | 14 | 7.37 | 0.22 | 40 | 28.38 | 0.21 | 44 | 1.10 |
| Production Example 45 | ClGaPc | 0.67 | 0.23 | 14 | 7.36 | 0.18 | 48 | 28.41 | 0.21 | 44 | 0.90 |
| Production Example 46 | ClGaPc | 0.67 | 0.23 | 14 | 7.37 | 0.19 | 48 | 28.39 | 0.18 | 49 | 1.04 |
| Production Example 47 | ClGaPc | 0.58 | 0.23 | 14 | 7.36 | 0.24 | 36 | 28.35 | 0.29 | 31 | 0.86 |
| Production Example 48 | ClGaPc | 0.58 | 0.23 | 14 | 7.37 | 0.19 | 48 | 28.39 | 0.18 | 49 | 1.04 |

TABLE 2

Production Conditions and Physical Properties of Photosensitive Member

| Photosensitive member | | Photosensitive member physical properties | | | | | | | | | |
|---|---|---|---|---|---|---|---|---|---|---|---|
| | | Volume ratio | Charge generating layer thickness | Charge transport layer thickness | First peak | | | Second peak | | | |
| Production Example | Pigment | P | [μm] | [μm] | $2\theta_1$ | $\beta_1$ | $r_1$ | $2\theta_2$ | $\beta_2$ | $r_2$ | A |
| Production Example 49 | HOGaPc | 0.58 | 0.23 | 14 | 7.40 | 0.35 | 25 | 28.13 | 0.30 | 30 | 1.21 |
| Production Example 50 | HOGaPc | 0.58 | 0.23 | 14 | 7.42 | 0.29 | 30 | 28.12 | 0.29 | 31 | 1.04 |
| Production Example 51 | HOGaPc | 0.58 | 0.23 | 14 | 7.42 | 0.26 | 34 | 28.12 | 0.28 | 33 | 0.98 |
| Production Example 52 | HOGaPc | 0.58 | 0.23 | 14 | 7.43 | 0.27 | 33 | 28.13 | 0.27 | 33 | 1.03 |
| Production Example 53 | HOGaPc | 0.58 | 0.23 | 14 | 7.43 | 0.27 | 33 | 28.14 | 0.27 | 34 | 1.02 |
| Production Example 54 | HOGaPc | 0.58 | 0.23 | 14 | 7.44 | 0.29 | 30 | 28.15 | 0.27 | 34 | 1.13 |
| Production Example 55 | HOGaPc | 0.58 | 0.23 | 14 | 7.45 | 0.27 | 33 | 28.15 | 0.27 | 34 | 1.04 |
| Production Example 56 | HOGaPc | 0.58 | 0.23 | 14 | 7.46 | 0.28 | 32 | 28.16 | 0.26 | 36 | 1.11 |
| Production Example 57 | HOGaPc | 0.58 | 0.23 | 14 | 7.46 | 0.27 | 33 | 28.16 | 0.28 | 33 | 1.00 |
| Production Example 58 | HOGaPc | 0.58 | 0.23 | 14 | 7.46 | 0.25 | 35 | 28.16 | 0.28 | 32 | 0.91 |
| Production Example 59 | HOGaPc | 0.58 | 0.23 | 14 | 7.42 | 0.26 | 34 | 28.21 | 0.31 | 29 | 0.87 |
| Production Example 60 | HOGaPc | 0.58 | 0.23 | 14 | 7.44 | 0.27 | 33 | 28.26 | 0.31 | 29 | 0.89 |
| Production Example 61 | HOGaPc | 0.58 | 0.23 | 14 | 7.40 | 0.28 | 32 | 28.13 | 0.32 | 28 | 0.90 |
| Production Example 62 | HOGaPc | 0.58 | 0.23 | 14 | 7.41 | 0.27 | 32 | 28.11 | 0.26 | 35 | 1.09 |
| Production Example 63 | HOGaPc | 0.58 | 0.23 | 14 | 7.41 | 0.27 | 33 | 28.12 | 0.29 | 31 | 0.95 |
| Production Example 64 | HOGaPc | 0.58 | 0.23 | 14 | 7.42 | 0.26 | 34 | 28.13 | 0.29 | 31 | 0.93 |
| Production Example 65 | HOGaPc | 0.58 | 0.23 | 11 | 7.45 | 0.27 | 33 | 28.15 | 0.27 | 34 | 1.04 |
| Production Example 66 | HOGaPc | 0.58 | 0.23 | 17 | 7.45 | 0.27 | 33 | 28.15 | 0.27 | 34 | 1.04 |
| Production Example 67 | HOGaPc | 0.58 | 0.23 | 20 | 7.45 | 0.27 | 33 | 28.15 | 0.27 | 34 | 1.04 |
| Production Example 68 | HOGaPc | 0.58 | 0.23 | 23 | 7.45 | 0.27 | 33 | 28.15 | 0.27 | 34 | 1.04 |
| Production Example 69 | HOGaPc | 0.58 | 0.23 | 27 | 7.45 | 0.27 | 33 | 28.15 | 0.27 | 34 | 1.04 |
| Production Example 70 | HOGaPc | 0.58 | 0.21 | 14 | 7.41 | 0.27 | 33 | 28.12 | 0.29 | 31 | 0.95 |
| Production Example 71 | HOGaPc | 0.58 | 0.25 | 14 | 7.41 | 0.27 | 33 | 28.12 | 0.29 | 31 | 0.95 |
| Production Example 72 | HOGaPc | 0.58 | 0.35 | 14 | 7.41 | 0.27 | 33 | 28.12 | 0.29 | 31 | 0.95 |
| Production Example 73 | HOGaPc | 0.58 | 0.21 | 14 | 7.46 | 0.27 | 33 | 28.16 | 0.28 | 33 | 1.00 |
| Production Example 74 | HOGaPc | 0.58 | 0.25 | 14 | 7.46 | 0.27 | 33 | 28.16 | 0.28 | 33 | 1.00 |
| Production Example 75 | HOGaPc | 0.58 | 0.35 | 14 | 7.46 | 0.27 | 33 | 28.16 | 0.28 | 33 | 1.00 |
| Production Example 76 | HOGaPc | 0.55 | 0.23 | 14 | 7.46 | 0.27 | 33 | 28.16 | 0.28 | 33 | 1.00 |
| Production Example 77 | HOGaPc | 0.67 | 0.23 | 14 | 7.46 | 0.27 | 33 | 28.16 | 0.28 | 33 | 1.00 |
| Production Example 78 | HOGaPc | 0.73 | 0.23 | 14 | 7.46 | 0.27 | 33 | 28.16 | 0.28 | 33 | 1.00 |
| Production Example 79 | ClGaPc | 0.58 | 0.23 | 14 | 7.50 | 0.36 | 25 | 28.20 | 0.31 | 29 | 1.17 |
| Production Example 80 | ClGaPc | 0.58 | 0.23 | 14 | 7.53 | 0.38 | 24 | 28.21 | 0.33 | 28 | 1.17 |
| Production Example 81 | HOGaPc | 0.58 | 0.23 | 14 | 7.59 | 0.24 | 37 | 28.61 | 0.24 | 38 | 1.03 |
| Production Example 82 | HOGaPc | 0.58 | 0.23 | 14 | 7.46 | 0.27 | 33 | 28.33 | 0.33 | 28 | 0.83 |
| Production Example 83 | HOGaPc | 0.58 | 0.23 | 14 | 7.65 | 0.25 | 36 | 28.62 | 0.31 | 30 | 0.83 |
| Production Example 84 | HOGaPc | 0.58 | 0.23 | 14 | 7.43 | 0.36 | 25 | 28.26 | 0.44 | 20 | 0.82 |
| Production Example 85 | HOGaPc | 0.58 | 0.23 | 14 | 7.38 | 0.37 | 24 | 28.24 | 0.45 | 20 | 0.83 |
| Production Example 86 | HOGaPc | 0.58 | 0.23 | 14 | 7.36 | 0.42 | 21 | 28.20 | 0.51 | 18 | 0.83 |

TABLE 2-continued

| Production Conditions and Physical Properties of Photosensitive Member | | | | | | | | | | | |
|---|---|---|---|---|---|---|---|---|---|---|---|
| | | Photosensitive member physical properties | | | | | | | | | |
| Photosensitive member | | Volume ratio | Charge generating layer thickness | Charge transport layer thickness | First peak | | | Second peak | | | |
| Production Example | Pigment | P | [μm] | [μm] | $2\theta_1$ | $\beta_1$ | $r_1$ | $2\theta_2$ | $\beta_2$ | $r_2$ | A |
| Production Example 87 | HOGaPc | 0.58 | 0.23 | 14 | 7.30 | 0.53 | 17 | 27.89 | 0.47 | 19 | 1.17 |
| Production Example 88 | HOGaPc | 0.58 | 0.23 | 14 | 7.29 | 0.56 | 16 | 27.86 | 0.44 | 20 | 1.30 |

Evaluation of Electrophotographic Photosensitive Members

Reduction of dark decay and discrete dot reproductivity of the electrophotographic photosensitive members produced above were examined at normal temperature and normal humidity (23° C., 50% RH). In "recording conditions" shown in Tables 3 and 4, "$V_d$" represents charged potential set for examination; "electric field intensity" is the quotient of the charged potential divided by the thickness of the charge transport layer in the corresponding Photosensitive Member Production Example; "$V_1$" represents the exposure potential; and "$V_{dc}$" represents the development potential.

A laser beam printer Color Laser Jet Enterprise M552 manufactured by Hewlett-Packard was modified as below for using examinations. The laser beam printer was modified so that the charging conditions and the amount of laser exposure could be varied. Also, the printer was modified so as to be operable in a state where the black process cartridge, to which any of the above-prepared electrophotographic photosensitive members was mounted, was attached to the station of the black process cartridge of the printer even if the process cartridges for the other colors (cyan, magenta, and yellow) were not attached. For measuring the surface potential of the electrophotographic photosensitive member, a potential probe Model 6000B-8 (manufactured by Trek Japan) was put at the developing position of the process cartridge, and the surface potential at the center in the longitudinal direction of the electrophotographic photosensitive member was measured with a surface electrometer Model 344 (manufactured by Trek Japan).

For outputting images, only the black process cartridge was mounted to the laser beam printer, and black single-color images were output.

Examination on Reduction of Dark Decay

The dark decay of each electrophotographic photosensitive member was determined as below. The surface potential ($Vd_{0.1}$) 0.1 second after being charged and the surface potential ($Vd_{1.0}$) 1.0 second after being charged were measured, and the proportion (Vdd) of $Vd_{1.0}$ to $Vd_{0.1}$ was defined as the dark decay. First, the dark decay was measured at normal temperature and normal humidity (23° C., 50% RH). The results are shown in Tables 3 to 4. The larger the Vdd value, the larger the reduction in dark decay.

Examination on Discrete Dot Reproductivity

Figure 5:
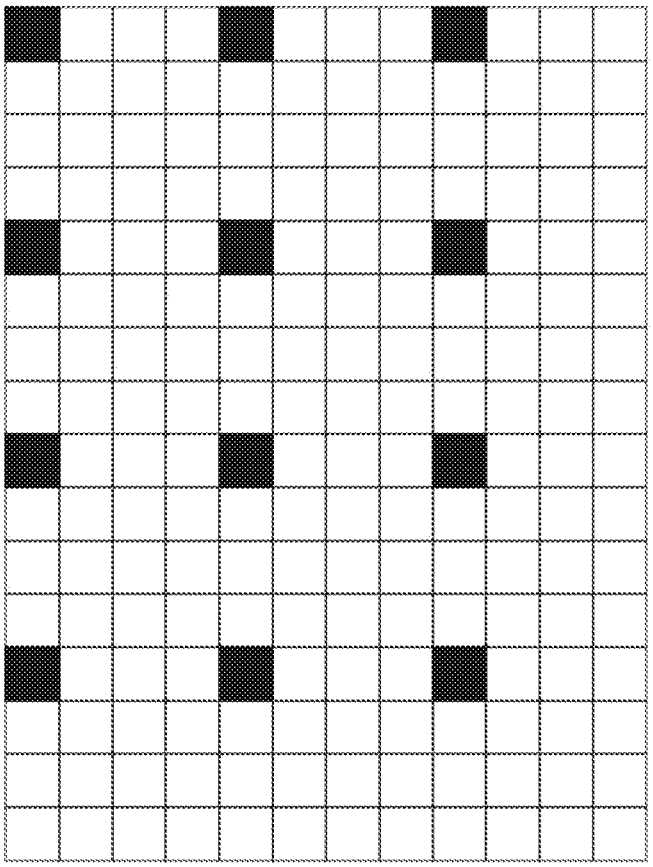
FIG. 5 is an illustrative representation of a discrete dot pattern used for evaluation, according to one more aspect of the subject disclosure.

The discrete dot reproductivity was examined at the same charged potential as the charged potential set for the dark decay examination. An image pattern as shown in FIG. 5, including dots formed by exposure at three-dot intervals was used for examination under the same charged potential conditions as in the dark decay examination. The discrete dot reproductivity was evaluated based on the image density (%) calculated from the difference in whiteness of the outputted image pattern, measured with REFLECTMETER MODEL TC-6DS (manufactured by Tokyo Denshoku), between the white portions and the portions patched with dots. In this instance, an umber filter was used as the filter. When the image density of the outputted image pattern was 8.0% or more, it was determined that exposed dots were clearly reproduced. The results of the examination at normal temperature and normal humidity were shown in Tables 3 and 4.

TABLE 3

| Evaluation Results | | | | | | | | |
|---|---|---|---|---|---|---|---|---|
| | | | Recording conditions | | | | | |
| | | | | Electric field | | | Results | |
| Example | Photosensitive member Production Example No. | A | Vd [V] | intensity [V/μm] | $V_l$ [V] | $V_{dc}$ [V] | Dark decay Vdd | Discrete dot reproductivity |
| Example 1 | Production Example 1 | 0.60 | 650 | 46 | 150 | 350 | 96.8% | 9.8% |
| Example 2 | Production Example 2 | 0.72 | 650 | 46 | 150 | 350 | 97.1% | 9.9% |
| Example 3 | Production Example 3 | 0.59 | 650 | 46 | 150 | 350 | 98.6% | 10.7% |
| Example 4 | Production Example 4 | 0.60 | 650 | 46 | 150 | 350 | 98.6% | 9.7% |
| Example 5 | Production Example 5 | 0.60 | 650 | 46 | 150 | 350 | 98.6% | 10.2% |
| Example 6 | Production Example 6 | 0.74 | 650 | 46 | 150 | 350 | 96.6% | 10.2% |
| Example 7 | Production Example 7 | 0.69 | 650 | 46 | 150 | 350 | 97.1% | 10.1% |
| Example 8 | Production Example 8 | 0.61 | 650 | 46 | 150 | 350 | 98.2% | 10.4% |
| Example 9 | Production Example 9 | 0.59 | 650 | 46 | 150 | 350 | 98.4% | 9.9% |
| Example 10 | Production Example 10 | 0.61 | 650 | 46 | 150 | 350 | 98.6% | 10.1% |
| Example 11 | Production Example 11 | 0.75 | 650 | 46 | 150 | 350 | 94.1% | 9.8% |
| Example 12 | Production Example 12 | 0.61 | 650 | 46 | 150 | 350 | 94.3% | 9.9% |
| Example 13 | Production Example 13 | 0.63 | 650 | 46 | 150 | 350 | 96.4% | 10.4% |
| Example 14 | Production Example 14 | 0.51 | 650 | 46 | 150 | 350 | 95.3% | 9.8% |

TABLE 3-continued

| Evaluation Results | | | | | | | | |
|---|---|---|---|---|---|---|---|---|
| | | | Recording conditions | | | | | |
| | | | | Electric field | | | Results | |
| Example | Photosensitive member Production Example No. | A | Vd [V] | intensity [V/μm] | $V_l$ [V] | $V_{dc}$ [V] | Dark decay Vdd | Discrete dot reproductivity |
| Example 15 | Production Example 15 | 0.55 | 650 | 46 | 150 | 350 | 95.7% | 10.6% |
| Example 16 | Production Example 16 | 0.50 | 650 | 46 | 150 | 350 | 96.6% | 10.1% |
| Example 17 | Production Example 17 | 0.56 | 650 | 46 | 150 | 350 | 96.2% | 10.0% |
| Example 18 | Production Example 18 | 0.52 | 750 | 54 | 150 | 350 | 99.1% | 13.3% |
| Example 19 | Production Example 19 | 0.52 | 750 | 54 | 150 | 350 | 98.2% | 12.8% |
| Example 20 | Production Example 20 | 0.58 | 750 | 54 | 150 | 350 | 98.4% | 12.1% |
| Example 21 | Production Example 21 | 0.64 | 750 | 54 | 150 | 350 | 98.1% | 12.0% |
| Example 22 | Production Example 22 | 0.73 | 750 | 54 | 150 | 350 | 95.1% | 12.2% |
| Example 23 | Production Example 23 | 0.61 | 650 | 59 | 150 | 350 | 97.7% | 12.6% |
| Example 24 | Production Example 24 | 0.61 | 650 | 38 | 150 | 350 | 98.2% | 10.5% |
| Example 25 | Production Example 25 | 0.61 | 650 | 33 | 150 | 350 | 98.9% | 9.1% |
| Example 26 | Production Example 26 | 0.61 | 650 | 28 | 150 | 350 | 98.8% | 8.5% |
| Example 27 | Production Example 27 | 0.61 | 650 | 24 | 150 | 350 | 99.0% | 8.1% |
| Example 28 | Production Example 28 | 0.61 | 650 | 46 | 150 | 350 | 98.6% | 10.6% |
| Example 29 | Production Example 29 | 0.61 | 650 | 46 | 150 | 350 | 98.3% | 10.1% |
| Example 30 | Production Example 30 | 0.61 | 650 | 46 | 150 | 350 | 98.2% | 10.2% |
| Example 31 | Production Example 31 | 0.50 | 750 | 54 | 150 | 350 | 97.9% | 12.6% |
| Example 32 | Production Example 32 | 0.50 | 750 | 54 | 150 | 350 | 98.1% | 12.6% |
| Example 33 | Production Example 33 | 0.50 | 750 | 54 | 150 | 350 | 98.1% | 12.5% |
| Example 34 | Production Example 34 | 0.61 | 750 | 54 | 150 | 350 | 98.3% | 9.9% |
| Example 35 | Production Example 35 | 0.61 | 750 | 54 | 150 | 350 | 94.4% | 11.0% |
| Example 36 | Production Example 36 | 0.61 | 750 | 54 | 150 | 350 | 92.9% | 10.9% |
| Example 37 | Production Example 37 | 0.50 | 750 | 54 | 150 | 350 | 98.4% | 9.3% |
| Example 38 | Production Example 38 | 0.50 | 750 | 54 | 150 | 350 | 94.4% | 10.4% |
| Example 39 | Production Example 39 | 0.50 | 750 | 54 | 150 | 350 | 92.4% | 10.6% |
| Example 40 | Production Example 40 | 0.52 | 750 | 54 | 150 | 350 | 98.7% | 10.9% |
| Example 41 | Production Example 41 | 0.52 | 750 | 54 | 150 | 350 | 94.0% | 11.6% |
| Example 42 | Production Example 42 | 0.52 | 750 | 54 | 150 | 350 | 91.8% | 10.8% |
| Example 43 | Production Example 43 | 0.86 | 750 | 54 | 150 | 350 | 98.2% | 10.4% |
| Example 44 | Production Example 44 | 1.10 | 750 | 54 | 150 | 350 | 97.9% | 10.1% |
| Example 45 | Production Example 45 | 0.90 | 750 | 54 | 150 | 350 | 96.9% | 11.3% |
| Example 46 | Production Example 46 | 1.04 | 750 | 54 | 150 | 350 | 96.3% | 10.3% |
| Example 47 | Production Example 47 | 0.86 | 750 | 54 | 150 | 350 | 98.1% | 10.2% |
| Example 48 | Production Example 48 | 1.04 | 750 | 54 | 150 | 350 | 98.5% | 10.4% |

TABLE 4

| Evaluation Results | | | | | | | | |
|---|---|---|---|---|---|---|---|---|
| | | | Recording conditions | | | | | |
| | | | | Electric field | | | Results | |
| Example | Photosensitive member Production Example No. | A | Vd [V] | intensity [V/μm] | $V_l$ [V] | $V_{dc}$ [V] | Dark decay Vdd | Discrete dot reproductivity |
| Comparative Example 1 | Production Example 49 | 1.21 | 650 | 46 | 150 | 350 | 77.6% | 10.5% |
| Comparative Example 2 | Production Example 50 | 1.04 | 650 | 46 | 150 | 350 | 79.9% | 10.3% |
| Comparative Example 3 | Production Example 51 | 0.98 | 650 | 46 | 150 | 350 | 82.0% | 10.5% |
| Comparative Example 4 | Production Example 52 | 1.03 | 650 | 46 | 150 | 350 | 81.4% | 10.0% |
| Comparative Example 5 | Production Example 53 | 1.02 | 650 | 46 | 150 | 350 | 82.2% | 10.5% |
| Comparative Example 6 | Production Example 54 | 1.13 | 650 | 46 | 150 | 350 | 83.4% | 10.6% |
| Comparative Example 7 | Production Example 55 | 1.04 | 650 | 46 | 150 | 350 | 83.2% | 10.6% |
| Comparative Example 8 | Production Example 56 | 1.11 | 650 | 46 | 150 | 350 | 83.6% | 10.1% |
| Comparative Example 9 | Production Example 57 | 1.00 | 650 | 46 | 150 | 350 | 83.5% | 10.3% |
| Comparative Example 10 | Production Example 58 | 0.91 | 650 | 46 | 150 | 350 | — | 10.4% |
| Comparative Example 11 | Production Example 59 | 0.87 | 650 | 46 | 150 | 350 | 79.0% | 10.6% |
| Comparative Example 12 | Production Example 60 | 0.89 | 650 | 46 | 150 | 350 | 74.9% | 10.1% |
| Comparative Example 13 | Production Example 61 | 0.90 | 650 | 46 | 150 | 350 | 79.4% | 10.0% |
| Comparative Example 14 | Production Example 62 | 1.09 | 650 | 46 | 150 | 350 | 83.1% | 10.6% |
| Comparative Example 15 | Production Example 63 | 0.95 | 650 | 46 | 150 | 350 | 84.1% | 10.5% |
| Comparative Example 16 | Production Example 64 | 0.93 | 650 | 46 | 150 | 350 | 85.5% | 9.8% |
| Comparative Example 17 | Production Example 65 | 1.04 | 650 | 59 | 150 | 350 | 82.4% | 13.0% |
| Comparative Example 18 | Production Example 66 | 1.04 | 650 | 38 | 150 | 350 | 86.7% | 9.7% |
| Comparative Example 19 | Production Example 67 | 1.04 | 650 | 33 | 150 | 350 | 88.3% | 8.3% |
| Comparative Example 20 | Production Example 68 | 1.04 | 650 | 28 | 150 | 350 | 87.3% | 7.9% |
| Comparative Example 21 | Production Example 69 | 1.04 | 650 | 24 | 150 | 350 | 88.7% | 7.5% |

TABLE 4-continued

| Evaluation Results | | | | | | | | |
|---|---|---|---|---|---|---|---|---|
| | | | Recording conditions | | | | | |
| | | | | Electric field | | | Results | |
| Example | Photosensitive member Production Example No. | A | Vd [V] | intensity [V/μm] | $V_l$ [V] | $V_{dc}$ [V] | Dark decay Vdd | Discrete dot reproductivity |
| Comparative Example 22 | Production Example 70 | 0.95 | 650 | 46 | 150 | 350 | 87.4% | 10.4% |
| Comparative Example 23 | Production Example 71 | 0.95 | 650 | 46 | 150 | 350 | 85.5% | 10.5% |
| Comparative Example 24 | Production Example 72 | 0.95 | 650 | 46 | 150 | 350 | 82.1% | 10.2% |
| Comparative Example 25 | Production Example 73 | 1.00 | 650 | 46 | 150 | 350 | 86.7% | 9.7% |
| Comparative Example 26 | Production Example 74 | 1.00 | 650 | 46 | 150 | 350 | 85.5% | 10.2% |
| Comparative Example 27 | Production Example 75 | 1.00 | 650 | 46 | 150 | 350 | 81.9% | 10.6% |
| Comparative Example 28 | Production Example 76 | 1.00 | 650 | 46 | 150 | 350 | 81.7% | 10.1% |
| Comparative Example 29 | Production Example 77 | 1.00 | 650 | 46 | 150 | 350 | 82.0% | 10.6% |
| Comparative Example 30 | Production Example 78 | 1.00 | 650 | 46 | 150 | 350 | 82.3% | 10.9% |
| Comparative Example 31 | Production Example 79 | 1.17 | 650 | 46 | 150 | 350 | 81.7% | 10.6% |
| Comparative Example 32 | Production Example 80 | 1.17 | 650 | 46 | 150 | 350 | 81.9% | 10.5% |
| Comparative Example 33 | Production Example 81 | 1.03 | 650 | 46 | 150 | 350 | 81.9% | 10.2% |
| Comparative Example 34 | Production Example 82 | 0.83 | 650 | 46 | 150 | 350 | 81.9% | 10.1% |
| Comparative Example 35 | Production Example 83 | 0.83 | 650 | 46 | 150 | 350 | 81.6% | 10.8% |
| Comparative Example 36 | Production Example 84 | 0.82 | 650 | 46 | 150 | 350 | 82.2% | 10.7% |
| Comparative Example 37 | Production Example 85 | 0.83 | 650 | 46 | 150 | 350 | 81.9% | 10.5% |
| Comparative Example 38 | Production Example 86 | 0.83 | 650 | 46 | 150 | 350 | 82.3% | 10.1% |
| Comparative Example 39 | Production Example 87 | 1.17 | 650 | 46 | 150 | 350 | 82.4% | 10.3% |
| Comparative Example 40 | Production Example 88 | 1.30 | 650 | 46 | 150 | 350 | 81.6% | 10.3% |

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-089520 filed Apr. 28, 2017, which is hereby incorporated by reference herein in its entirety.

What is claimed is:

1. An electrophotographic photosensitive member comprising, in this order:

a support;

a charge generating layer having a thickness of more than 200 nm and containing a hydroxygallium phthalocyanine pigment as a charge generating material; and a charge transport layer containing a charge transporting material, wherein when a CuKα X-ray diffraction spectrum of the hydroxylgallium phthalocyanine pigment is obtained by characteristic powder X-ray diffractometry, in which the hydroxygallium phthalocyanine pigment enclosed in a boro-silicate capillary having a length of 70 mm, a thickness of 0.01 mm, and inner diameter of 0.7 mm, is irradiated with X-ray radiation while rotating the capillary, in the CuKα X-ray diffraction spectrum,—peaks at Bragg angles 2θ of 7.4°±0.3° and 28.2°±0.3° are observed, and parameter A represented by the following equation (1) is 0.80 or less:

$$A = \frac{\beta_1 \cos\theta_1}{\beta_2 \cos\theta_2} \quad (1)$$

wherein $\theta_1$ and $\beta_1$ respectively represent the angle and the integral width of the peak at the Bragg angle 2θ of 7.4°±0.3°, and $\theta_2$ and $\beta_2$ respectively represent the angle and the integral width of the peak at the Bragg angle 2θ of 28.2°±0.3° in the CuKα X-ray diffraction spectrum, and wherein the ratio of the volume of the charge generating material to the entire volume of the charge generating layer is in the range of 0.58 to 0.75.

2. The electrophotographic photosensitive member according to claim 1, wherein the integral width $\beta_2$ is larger than 0.4°.

3. A process cartridge capable of being removably attached to an electrophotographic apparatus, the process cartridge comprising:

an electrophotographic photosensitive member; and at least one device selected from the group consisting of a charging device, a developing device, and a cleaning device, the at least one device being held together with the electrophotographic photosensitive member in one body, wherein the electrophotographic photosensitive member includes, in this order, a support, a charge generating layer having a thickness of more than 200 nm and containing a hydroxygallium phthalocyanine pigment, and a charge transport layer containing a charge transporting material, and wherein when a CuKα X-ray diffraction spectrum of the hydroxygallium phthalocyanine pigment is obtained by a characteristic powder X-ray diffractometry, in which the hydroxygallium phthalocyanine pigment enclosed in a boro-silicate capillary having a length of 70 mm, a thickness of 0.01 mm, and inner diameter of 0.7 mm, is irradiated with X-ray radiation while rotating the capillary, in the CuKα X-ray diffraction spectrum, peaks at Bragg angles 2θ of 7.4°±0.3° and 28.2°±0.3° are observed, and parameter A represented by the following equation (1) is 0.80 or less:

$$A = \frac{\beta_1 \cos\theta_1}{\beta_2 \cos\theta_2} \quad (1)$$

wherein in the equation (1), $\theta_1$ and $\beta_1$ respectively represent the angle and the integral width of the peak at the Bragg angle 2θ of 7.4°±0.3°, and $\theta_2$ and $\beta_2$ respectively represent the angle and the integral width of the peak at the Bragg angle 2θ of 28.2°±0.3° in the CuKα X-ray diffraction spectrum, and wherein the ratio of the volume of the charge generating material to the entire volume of the charge generating layer is in the range of 0.58 to 0.75.

4. An electrophotographic apparatus comprising:

an electrophotographic photosensitive member;

a charging device;

an exposure device;

a developing device; and a transfer device, wherein the electrophotographic photosensitive member includes, in this order, a support, a charge generating layer having a thickness of more than 200 nm and containing a a hydroxygallium phthalocyanine pigment, and a charge transport layer containing a charge transporting material, and wherein when a CuKα X-ray diffraction spectrum of the hydroxygallium phthalocyanine pigment is obtained by characteristic powder X-ray diffractometry, in which the hydroxylgallium phthalocyanine pigment enclosed in a boro-silicate capillary having a length of 70 mm, a thickness of 0.01 mm, and inner diameter of 0.7 mm, is irradiated with X-ray radiation while rotating the capillary, in the CuKα X-ray diffraction spectrum, peaks at Bragg angles 2θ of 7.4°±0.3° and 28.2°±0.3° are observed, and parameter A represented by the following equation (1) is 0.80 or less:

$$A = \frac{\beta_1 \cos\theta_1}{\beta_2 \cos\theta_2} \quad (1)$$

wherein in the equation (1), $\theta_1$ and $\beta_1$ respectively represent the angle and the integral width of the peak at the Bragg angle 2θ of 7.4°±0.3°, and $\theta_2$ and $\beta_2$ respectively represent the angle and the integral width of the peak at the Bragg angle 2θ of 28.2°±0.3° in the CuKα X-ray diffraction spectrum, and wherein the ratio of the volume of the charge generating material to the entire volume of the charge generating layer is in the range of 0.58 to 0.75.

* * * * *